US005663787A

United States Patent [19]

Haneda et al.

[11] Patent Number: 5,663,787

[45] Date of Patent: Sep. 2, 1997

[54] ELECTROPHOTOGRAPHIC COLOR IMAGE FORMING APPARATUS WITH IMAGE EXPOSURE MEANS INSIDE OF PHOTORECEPTOR DRUM

[75] Inventors: Satoshi Haneda; Masakazu Fukuchi; Tadayoshi Ikeda, all of Hachioji, Japan

[73] Assignee: Konica Corporation, Tokyo, Japan

[21] Appl. No.: 662,817

[22] Filed: Jun. 12, 1996

Related U.S. Application Data

[63] Continuation of Ser. No. 397,918, Mar. 3, 1995, abandoned.

[30] Foreign Application Priority Data

| | | | |
|---|---|---|---|
| Mar. 11, 1994 | [JP] | Japan | 6-041297 |
| Jun. 24, 1994 | [JP] | Japan | 6-143360 |
| Aug. 24, 1994 | [JP] | Japan | 6-199727 |
| Sep. 2, 1994 | [JP] | Japan | 6-209743 |
| Sep. 12, 1994 | [JP] | Japan | 6-217429 |

[51] Int. Cl.[6] ..... G03G 15/00; G03G 21/18

[52] U.S. Cl. ..... 355/111; 394/118; 347/138; 347/118

[58] Field of Search ..... 399/111, 112, 399/114, 117, 118; 347/115, 118, 130, 138, 152, 232, 238, 245

[56] References Cited

U.S. PATENT DOCUMENTS

| | | | |
|---|---|---|---|
| 4,470,689 | 9/1984 | Nomura et al. | 355/211 |
| 4,703,334 | 10/1987 | Mochimaru et al. | 347/130 |
| 5,235,383 | 8/1993 | Tada et al. | 355/200 |
| 5,339,132 | 8/1994 | Tomita et al. | 355/200 |

FOREIGN PATENT DOCUMENTS

| | | | |
|---|---|---|---|
| 5-307307 | 11/1993 | Japan | 355/327 |

*Primary Examiner*—Joan H. Pendegrass

*Attorney, Agent, or Firm*—Frishauf, Holtz, Goodman, Langer & Chick

[57] ABSTRACT

A color image forming apparatus wherein an image forming body has a inner surface and a outer surface, a charging device electrically charges the outer surface, and an exposure device imagewise exposes the inner surface. A developing device is used to form a first toner image on the outer surface. A unit is detachablly mounted in a housing of the apparatus, wherein the image forming body and a plurality of the exposure devices are provided in the unit.

31 Claims, 32 Drawing Sheets

ELECTROPHOTOGRAPHIC COLOR IMAGE FORMING APPARATUS WITH IMAGE EXPOSURE MEANS INSIDE OF PHOTORECEPTOR DRUM

This application is a continuation of application Ser. No. 08/397,918, filed Mar. 3, 1995 now abandoned.

BACKGROUND OF THE INVENTION

The present invention relates to an electrophotographic color image forming apparatus in which a plurality of image exposure means and developing means are arranged along the circumferential surface of an image-forming object (a photoreceptor), the configuration of which is mainly formed to be drum-shaped, and toner images are formed and superimposed while the image-forming object is rotated by one revolution.

Concerning the method for forming a multi-color image, there have been known some methods including apparatus (A) in which photoreceptors, charging units and developing units each in number equivalent to the number of colors necessary for the multi-color image are provided, and toner images each being a mono-color formed on each photoreceptor are superimposed on an intermediate transfer object to form a color image, apparatus (B) in which one photoreceptor is rotated plural times so that charging, image exposure and developing for each color are repeated for forming a color image for each rotation, and apparatus (C) in which charging, image exposure and developing for each color are conducted in succession while one photoreceptor makes one turn for forming a color image.

However, the apparatus (A) has a drawback that the dimensions of the apparatus are increased because a plurality of photoreceptors and intermediate transfer objects are required, while the apparatus (B) has a restriction that the size of a formed image is limited to the surface area or less of the photoreceptor although the dimensions of the apparatus can be small because the required number of each of the charging means, image exposure means and photoreceptor is just one.

In the case of the apparatus (C), which makes it possible to form images at high speed, it still has a contradiction that the diameter of a photoreceptor is large and thereby the apparatus is also large due to the following two reasons; one is necessity that a plurality of charging units, image exposure means and developing units need to be arranged within a circumferential surface of the photoreceptor, and the other is necessity that the distance between the image exposure means and the developing unit needs to be long for avoiding a possibility that image quality is deteriorated by toner leaking from the developing unit to which an image exposure optical system is located close.

For the purpose of avoiding the drawback of the aforementioned contradiction in the apparatus (C), there has been suggested an apparatus in which the base of an image-forming object is formed from a transparent material, a plurality of image exposure means are housed in the image-forming object, and a light-sensitive layer formed on the external surface of the base is exposed to light reflected on an image through the base (for example, Japanese Patent Publication Open to Public Inspection No. 307307/1993).

However, the above apparatus has drawbacks including complicated structure due to the arrangement of many image exposure means provided inside the image-forming object and many charging units and developing units provided outside the image-forming object, inefficient handling due to complicated mounting and dismounting of developing units, image-forming objects and image exposure means, and difficulty of keeping positional accuracy between various units. In particular, it requires an advanced technique to provide an optical system fixed inside the image-forming object and to rotate it or to mount and dismount it.

With regard to the exposure optical system, in particular, positional relationship between various parts in the optical system and that between the optical system and the image-forming object are kept to be highly accurate. Therefore, when deformation or displacement is caused by the mounting or dismounting of the image-forming object, registration or an image forming position is changed, resulting in inability to obtain excellent color images. It is preferable to integrate developing units and others into one body to the utmost.

The above problems are solved by the present invention. The first object of the present invention is to provide a color image forming apparatus characterized in that: it is possible to replace the image-forming body without affecting the image exposure means arranged in high accuracy; the layout of units is rationalized so that the positional accuracy of each unit can be maintained high and further each unit is arranged in a well-balanced condition; and the apparatus is made compact and handy.

According to the color image forming apparatus disclosed in the aforementioned Japanese Patent Publication Open to Public Inspection No. 307307/1993, the shaft penetrates through the image-forming body and the support body composed of a heat conductor for holding 4 image exposure means is provided in the image-forming body. Therefore, it is complicated and takes time to assemble the image forming body and the image exposure means, and it is also complicated to adjust a positional relation between the charger provided on the outer circumference of the image forming body and the image exposure means.

The present invention has been accomplished to solve the above problems. The second object of the present invention is to provide a color image forming apparatus characterized in that: it is possible to form a color image, the colors of which are well-balanced, and the length of which is not less than the circumferential length of the image forming body; the image exposure means provided inside the image forming body can be easily maintained and replaced; and it is easy to adjust a positional relation between the charger and developing units provided on the outer circumference of the image-forming body and the image exposure means.

A photoreceptor drum, which is an image-forming body, is rotated in the process of image formation and subjected to image exposure. A plurality of images are simultaneously superimposed on the photoreceptor drum by a plurality of optical exposure means. Due to the fluctuation of drive and unevenness of rotation, the accuracy of superimposed dots is deteriorated, so that the dots tend to be shifted. Since the photoreceptor drum is rotated while a plurality of developing units are being pressed against a surface of the photoreceptor drum, the rotation of the photoreceptor drum is fluctuated and image formation is made in an unstable condition. Each time the photoreceptor drum is attached to and detached from the apparatus body, the positional setting of the image exposure means with respect to the optical system must be conducted, and even if the position of each unit is mechanically regulated, an optical fluctuation which can not be neglected is caused and further the optical system is damaged. Therefore, it is impossible to form a clear image.

It is the third object of the present invention to solve the above problems so that the photoreceptor drum and developing units can be stably driven and the fluctuation of the photoreceptor drum is avoided and further the photoreceptor drum is combined with a stable exposure system so as to form an image of high quality.

In general, Selfoc Lens (brand name) is used in the image exposure means, and an optical exposure system, the light source of which is an LED, is used for the optical image forming system. When the optical exposure system is included in the image forming body and the LED is lit over a long period of time, generated heat is accumulated in the image forming body. Accordingly, there is a possibility that the photoreceptor layer and toner are deteriorated by the generated heat and further the registration function is changed by the effect of thermal expansion.

In order to solve the above problems, a heat pipe is conventionally embedded in a Support for supporting the optical exposure system so that the heat generated by the LED can be emitted outside.

However, even if the heat pipe, the cost of which is high, and the structure of which is complicated, is installed, the above problems can not be solved completely. Specifically, heat in the support is mainly emitted by the action of the heat pipe, and heat in other units including the image-forming unit can not be sufficiently cooled.

The present invention has solved the above problems. It is the fourth object of the present invention to provide a color image forming apparatus characterized in that: the units inside the image-forming body are widely and effectively cooled, so that the image forming function is not deteriorated even if the apparatus is used over a long period of time and images of high quality can be successively formed.

SUMMARY OF THE INVENTION

The first embodiment to accomplish the first object of the present invention is composed as follows.

The color image forming apparatus of the first embodiment of the present invention comprises:

an image forming body;

a first charging means for charging a first surface of the image forming body;

a first image exposure means for forming a first electrostatic latent image by conducting exposure from a second surface reverse to the first surface on the image forming body charged by the first charging means;

a first developing means for developing the first electrostatic latent image from the first surface so that a first toner image is formed on the image forming body;

a second charging means for charging the first surface of the image forming body having the first toner image;

a second image exposure means for forming a second electrostatic latent image by conducting exposure from the second surface on the image forming body charged by the second charging means;

a second developing means for developing the second electrostatic latent image from the first surface so that a second toner image is formed on the image forming body having the first toner image;

a transfer means for transferring the first and second toner images onto a recording medium by one operation; and a cleaning means for cleaning residual toner on the image forming body, wherein the image forming body and the first and second image exposure means are integrally formed and capable of being attached to and detached from the color image forming apparatus.

In the color image forming apparatus of the first example of the first embodiment of the present invention, a plurality of charging means, image exposure means and developing means are provided around the image forming body. The charging means conducts charging, the image exposure means conducts exposing, and the developing means conducts developing on the image forming body. When the above operation is repeated, toner images are formed on the image forming body. Then the toner images are transferred onto a transfer sheet by one operation. In the above color image forming apparatus, the image forming body integrally includes the image exposure means and is accommodated in the apparatus body.

In the color image forming apparatus of the second example of the first embodiment of the present invention, a plurality of charging means, image exposure means and developing means are provided around the image forming body. The charging means conducts charging, the image exposure means conducts exposing, and the developing means conducts developing on the image forming body. When the above operation is repeated, toner images are formed on the image forming body. Then the toner images are transferred onto a transfer sheet by one operation. In the above color image forming apparatus, the image forming body integrally includes the image exposure means and is attached to and detached from the apparatus body.

The second embodiment to accomplish the first object of the present invention is composed as follows.

The color image forming apparatus of the first embodiment of the present invention comprises:

an image forming body;

a first charging means for charging a first surface of the image forming body;

a first image exposure means for forming a first electrostatic latent image by conducting exposure from a second surface reverse to the first surface on the image forming body charged by the first charging means;

a first developing means for developing the first electrostatic latent image from the first surface so that a first toner image is formed on the image forming body;

a second charging means for charging the first surface of the image forming body having the first toner image;

a second image exposure means for forming a second electrostatic latent image by conducting exposure from the second surface on the image forming body charged by the second charging means;

a second developing means for developing the second electrostatic latent image from the first surface so that a second toner image is formed on the image forming body having the first toner image;

a transfer means for transferring the first and second toner images onto a recording medium by one operation; and a cleaning means for cleaning residual toner on the image forming body, wherein the first and second image exposure means are fixed to the color image forming apparatus, and the image forming body and the first and second charging means are integrally formed and detachably provided to the color image forming apparatus.

In the color image forming apparatus of the first example of the second embodiment of the present invention, the operation of charging, image exposure and developing is repeatedly conducted on a drum-shaped image forming body, and the formed toner images are superimposed on the image forming body and transferred onto a transfer sheet by one operation. In this color image forming apparatus, a plurality of image exposure means fixed to the apparatus body are capable of being inserted into the image forming body. The image forming body and a plurality of charging means and developing means provided in the periphery of the image forming body are accommodated in a cartridge and arranged on a frame having a fixing means by which the frame can be fixed to the apparatus body. Therefore, the image forming body, charging means and developing means provided on the cartridge can be pulled out from the apparatus.

In the color image forming apparatus of the second example of the second embodiment of the present invention, the operation of charging, image exposure and developing is repeatedly conducted on a drum-shaped image forming body, and the formed toner images are superimposed on the image forming body and transferred onto a transfer sheet by one operation. In this color image forming apparatus, a plurality of image exposure means fixed to the apparatus body are capable of being inserted into the image forming body. The image forming body and a plurality of charging means and developing means provided in the periphery of the image forming body are accommodated in a cartridge and arranged in a cartridge having a fixing means by which the cartridge can be fixed to the apparatus body, and the cartridge can be pulled out from the apparatus through a guide means.

In the color image forming apparatus of the third example of the second embodiment of the present invention, the operation of charging, image exposure and developing is repeatedly conducted on an image forming body, and the formed toner images are superimposed on the image forming body and transferred onto a transfer sheet by one operation. In the above image forming apparatus, the plurality of image exposure means are arranged on a support member fixed to the apparatus body and are capable of being inserted into the image forming body. After the image forming body has been attached to and detached from the apparatus, the plurality of image exposure means can be attached to and detached from the support body.

In the color image forming apparatus of the fourth example of the second embodiment of the present invention, the operation of charging, image exposure and developing is repeatedly conducted on an image forming body, and the formed toner images are superimposed on the image forming body and transferred onto a transfer sheet by one operation. In the above image forming apparatus, the plurality of image exposure means are arranged on a support member fixed to the apparatus body and are capable of being inserted into the image forming body. When the support member is attached at a reference position, a clearance between the image exposure means and the plurality of image forming body can be determined.

The second object of the present invention can be accomplished by a color image forming apparatus described below. On the outer circumference of a drum-shaped image forming body, there are provided a cleaning unit, 4 pairs of chargers and developing units, and a transfer means. Inside the drum-shaped image forming apparatus, there are provided 4 image exposure means. When the operation of charging, image exposure and developing is repeatedly conducted on the image forming body, different color toner images are superimposed, and the formed color image is transferred and fixed onto a transfer sheet. In the above color image forming apparatus, the image forming body is composed in the following manner. An end of the image forming body in the inserting direction into the apparatus body is an open end for receiving the image exposure means inside, and the image forming body is provided with a disk having a bearing at the rear end in the inserting direction. An inner circumferential surface on the open side is rotatably supported by a support means supported by the apparatus body. A drum gear provided on the outer circumference on the open end side is meshed with a drive gear supported by the apparatus body. A shaft fixed to the apparatus body is engaged with a bearing of the disk. Under the above condition, the image forming body is provided in the apparatus body.

The above object can be also accomplished by a color image forming apparatus characterized as follows. Four image exposure means are held by a columnar support, at least on one end surface of which a shaft hole is formed. The other end surface of the support is fixed onto a vertical surface of the apparatus body. In this way, the image exposure means are installed in the apparatus body. The image forming body is provided with a disk having a bearing on one end surface. The other end surface is an open end, on the outer circumference of which a drum gear is provided. The open end is inserted into the apparatus body while it takes the lead, and the support body is received inside, and the open end side is rotatably supported by the support means supported by the apparatus body. The drum gear is meshed with the drive gear supported by the apparatus body. When a shaft fixed to the apparatus body is engaged with the bearing of the disk of the image forming body and the shaft hole of the support, the apparatus body is installed in the apparatus body.

In the color image forming apparatus of the present invention, when the image forming body is inserted into the apparatus body while the open end side takes the lead, 4 image exposure means are received inside the image forming body from the open end. The image forming body is simply attached to the apparatus body in such a manner that the shaft fixed to the apparatus body is engaged with the bearing of the disk on the side opposite to the inserting direction of the image forming body. Therefore, under the condition in which the image forming body is removed, a positional relation between the chargers or developing units provided around the outer circumference of the image forming body and the 4 image exposure means provided inside the image forming apparatus body can be easily adjusted. Further, it is easy to assemble, maintain and replace the units of the color image forming apparatus such as the image forming body, cleaning unit, 4 pairs of chargers and developing units, transfer means and 4 image exposure means.

The third object of the present invention is accomplished by a color image forming apparatus in which a plurality of chargers, image exposure means and developing units are arranged in the moving direction of an image forming body, and the color image forming apparatus characterized in that: the image exposure means is arranged on a common support; a gear integrated with the image forming body is meshed with a drive gear of a drive source arranged outside the image forming body; and the developing unit is operated being meshed with a drive gear of a drive source arranged at the center of the image forming body. It is preferable that the image exposure means is arranged inside the image forming body. It is also preferable that the image exposure means is arranged outside the image forming body.

The first embodiment of the color image forming apparatus to accomplish the fourth object of the present invention is composed as follows. In the color image forming apparatus, the operations of charging conducted by charging means, image exposure conducted by image exposure means and development conducted by developing means are repeated, so that toner images are formed on the image forming body being superimposed. Then the toner images are simultaneously transferred onto a transfer sheet. The image exposure means is enclosed in the image forming body and cooled by an air current passing through inside the image forming body.

The second embodiment of the color image forming apparatus to accomplish the fourth object of the present invention is composed as follows. In the color image forming apparatus, the operations of charging conducted by a charging means, image exposure conducted by an image exposure means and development conducted by a developing means are repeated, so that toner images are formed on the image forming body being superimposed. Then the toner images are simultaneously transferred onto a transfer sheet. The image exposure means is enclosed in the image forming body and cooled by an air current circulating inside the image forming body.

DETAILED DESCRIPTION OF THE PREFERRED EMBODIMENT

Figure 1:
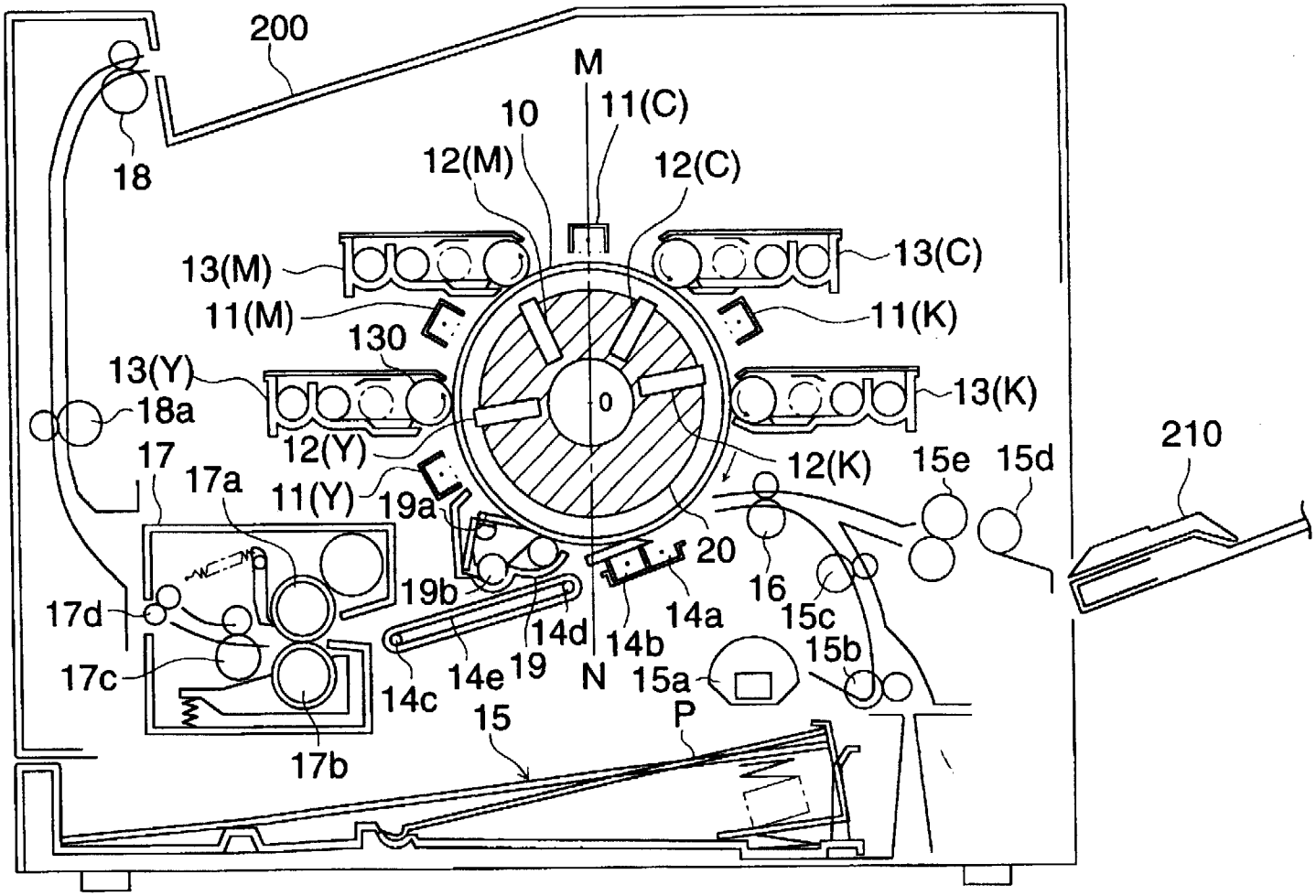
FIG. 1 is a sectional view showing the construction of the color image forming apparatus of the present invention.
Figure 2:
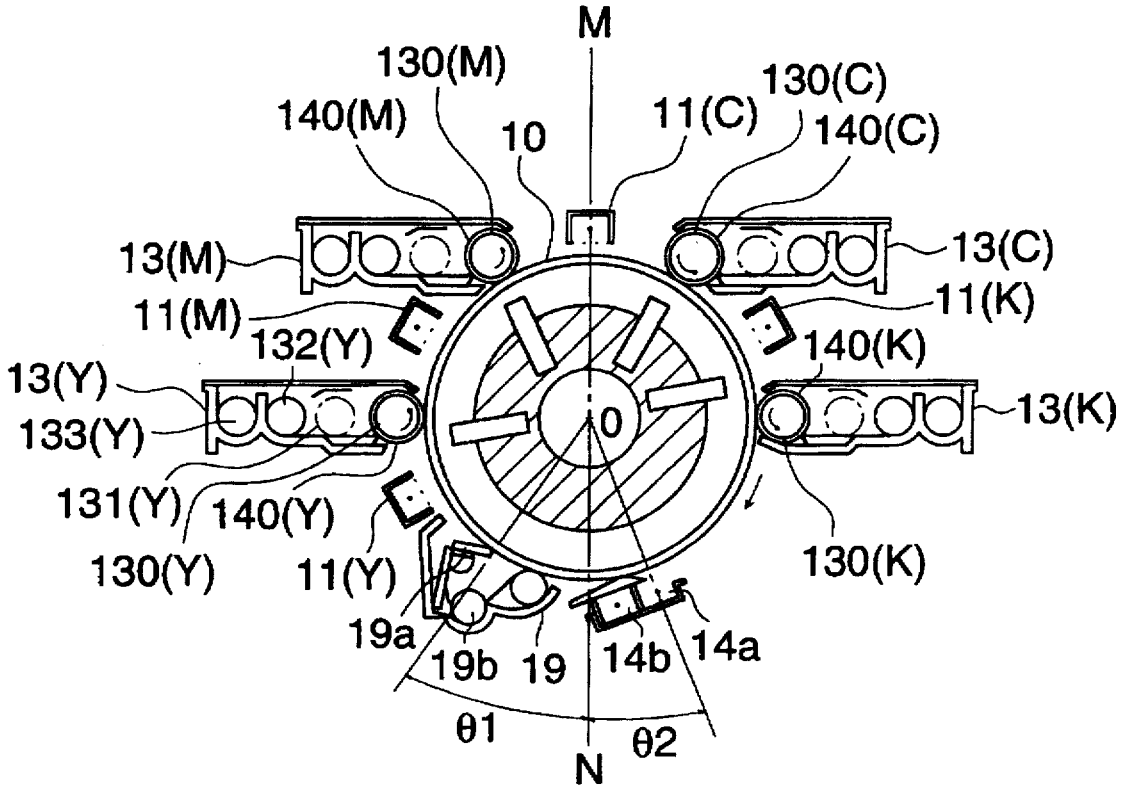
FIG. 2 is a view showing the primary portion of the apparatus described above.

Prior to explanation of the examples for attaining the first object of the invention, constitution of a color image forming apparatus which is common to all examples will be explained as follows, referring to FIGS. 1 and 2.

The numeral 10 is a drum-shaped image-forming object, that is, a photoreceptor drum, and it is composed of a cylindrical base object made of optical glass or a transparent member such as transparent acrylic resins whose external circumferential surface is coated with a transparent conductive layer, an a-Si layer or an organic photoconductor layer (OPC).

The numeral 11 represents a scorotron charging unit, and it charges electrically the aforementioned organic photoconductor layer of the photoreceptor drum 10 by means of a grid retained at a predetermined potential level and of corona discharge by a corona wire, and thus the photoreceptor drum 10 is given uniform potential.

Numeral 12 (Y, M, C, K) represents an optical exposure system composed of FL, EL, PL and LED in which light emitting diodes are aligned in the axial direction of the photoreceptor drum 10, and also composed of LISA, PLZT and LCS in which elements having an optical shutter function are aligned, and also composed of Selfoc lenses serving as a life-size image forming element. Image signals for each color read by a separate image reading device are taken out successively from a memory and are inputted as electric signals into each of the aforesaid optical exposure systems 12(Y, M, C, K). Each of the aforesaid optical exposure systems 12(Y, M, C, K) is attached on cylindrical supporting member 20, and thus the aforesaid optical exposure systems are housed inside the base of the photoreceptor drum 10.

The numerals 13Y to 13K are developing units containing respectively developing agents of yellow (Y), magenta (M), cyan (C) and K (black), and they are equipped respectively with developing sleeves 130 (Y, M, C, K) which rotate in the same direction keeping a predetermined distance with each other around the circumferential surface of the photoreceptor drum 10, while the predetermined distance is maintained by the action of collision rollers (Y, M, C, K). They are also equipped with supply rollers 131 (Y, M, C, K) for supplying developer to the developing sleeves 130 (Y, M, C, K). Further, they are equipped with stirring rollers 132 (Y, M, C, K) and 133 (Y, M, C, K). The developing sleeves 130 (Y, M, C, K) and the developer in the developing units 13 (Y, M, C, K) are maintained in a non-contact condition with respect to the photoreceptor drum 10. In this case, a distance between the photoreceptor drum 10 and each of the developing sleeves 130 (Y, M, C, K) is maintained by the action of each of the collision rollers 140 (Y, M, C, K) which pushes the photoreceptor drum 10 in the non-image portion at the drum end while idly rotating.

In this way, an electrostatic latent image is formed on the photoreceptor drum 10 by the charging conducted by the scorotron chargers 11 (Y, M, C, K) and the image exposure conducted by the optical exposure systems 12 (Y, M, C, K). The thus formed electrostatic latent image is subjected to reversal development by the developing units 13 (Y, M, C, K).

With regard to an image on a document, the image read by an image sensor in an image reading device which is separate from the present apparatus, or the image compiled by a computer is stored in a memory momentarily as image signals of each color of Y, M, C and K.

At the start of image recording, the photoreceptor driving motor starts rotating, and photoreceptor drum 10 is thereby rotated clockwise and the scorotron charging unit 11 (Y) starts giving potential to the photoreceptor drum 10 through its charging action simultaneously.

After the photoreceptor drum 10 is given potential, exposure by means of electric signals corresponding to the first color signals, namely yellow (Y) image signals is started in the exposure optics system 12 (Y), and an electrostatic latent image corresponding to yellow (Y) image of the document image is formed on a light-sensitive layer on the surface of the drum through rotary scanning of the drum.

The latent image mentioned above is subjected to reversal development conducted by developing unit 13 (Y) under the condition that developing agent on a developing sleeve is in the non-contact state, and a yellow (Y) toner image is formed as the photoreceptor drum 10 rotates.

Then, photoreceptor drum 10 is given potential on the yellow (Y) toner image thereon through charging operation of the scorotron charging unit 11 (M), then it is exposed to electric signals of optical exposure system 12 (M) corresponding to the second color signals, namely to magenta (M) image signals, and thereby a magenta (M) toner image is superposed on the aforementioned yellow (Y) toner image through reversal development of a non-contact type conducted by developing unit 13 (M).

In the same process as in the foregoing, a cyan (C) toner image corresponding to the third color signals formed by the scorotron charging unit 11 (C), optical exposure system 12 (C) and developing unit 13 (C) and a black (K) toner image corresponding to the fourth color signals formed by the scorotron charging unit 11 (K), optical exposure system 12 (K) and developing unit 13 (K) are formed and superposed in succession, thus a color toner image is formed on the circumferential surface of the photoreceptor drum 10 within its one rotation.

Exposure to an organic photoconductor layer of photoreceptor drum 10 is conducted by optical exposure systems 12 (Y, M, C, K) mentioned above through the transparent base object from the inside of the drum. Therefore, exposures of images corresponding respectively to the second, third and fourth color signals can be conducted without being affected by toner images formed in the preceding steps, and thus it is possible to form an electrostatic latent image identical to that corresponding to the first color signals. Incidentally, with regard to stabilization of a temperature and prevention of temperature rise in photoreceptor drum 10 relating to generation of heat caused by optical exposure systems 12(Y, M, C, K), a material having an excellent thermal conductivity is used for the supporting member 20, and when the temperature is low, a heater is used, while when it is high, a heat pipe is used for radiation of heat. In the case of developing operation conducted by each developing unit 13 (y, M, C, K), developing bias to which DC is added or AC is further added is impressed on each developing sleeve 130 (Y, M, C, K), then jumping development by means of mono-component or two-component developing agent contained in a developing unit is conducted, and reversal development of a non-contact basis is carried out for the photoreceptor drum 10 having a grounded transparent conductive layer while a DC bias, the polarity of which is the same as that of the toner, is impressed upon the photoreceptor drum 10.

A color toner image thus formed on the peripheral surface of the photoreceptor drum 10 is transferred onto a transfer sheet P by the action of the transfer unit 14*a*, wherein the transfer sheet P is sent out from the sheet feed cassette 15 by the feed roller 15*a* and conveyed to the timing roller 16 by a pair of conveyance rollers 15*b*, 15*c*, and the transfer sheet P is fed synchronously with the toner image on the photoreceptor drum 10 by the drive of the timing roller 16. In the case where the transfer sheet is a thick sheet of paper of OHT, the transfer sheet is sent to a manual feed tray 210 and then conveyed to the timing roller 16 by the manual feed roller 15*d* and a pair of conveyance rollers 15*e*.

Transfer sheet P onto which the toner image has been transferred is electrically discharged by the discharger 14*b*, so that the transfer sheet P is separated from the peripheral surface of the drum. Then the transfer sheet P is conveyed to the fixing unit 17 by the conveyance belt 14*e* provided between the drive conveyance roller 14*c* and the idle roller 14*d*. In the fixing unit 17, toner is heated and pressed by the fixing roller 17*a* and the pressure roller 17*b* so that the toner is fused and fixed onto the transfer sheet P. Then the transfer sheet P is discharged from the fixing unit 17 by the pulling rollers 17*c* and the fixing delivery rollers 17*d*. After that, the transfer sheet P is conveyed by the discharge paper conveyance rollers 18*a* and discharged to the paper discharge tray 200 on the apparatus through the paper discharge rollers 18.

After the transfer sheet has been separated from the photoreceptor drum 10, the surface of the photoreceptor drum 10 is rubbed by the cleaning blade 19*a* of the cleaning unit 19 so that the residual toner can be removed. In this way, the toner image formation is continued, or alternatively the toner image formation is once stopped and the formation of a new toner image is started. Used toner scraped off by the cleaning blade 19*a* is discharged to a used toner container not illustrated in the drawing by the action of the toner conveyance screw 19*b*.

Since the optical exposure system is arranged inside the photoreceptor drum 10, even if the drum diameter is relatively small, it is possible to arrange a plurality of scorotron chargers 11 (Y, M, C, K) and developing units 13 (Y, M, C, K) on the outer peripheral surface of the photoreceptor drum 10. When a drum of a small diameter of 60 mm to 150 mm is used, the apparatus can be made compact.

Spaces on the circumferential surface of the photoreceptor drum can be effectively utilized, and a compact well-balanced layout of the units can be provided when each unit is arranged in the following manner:

The developing units 13(M) and 13(C) are arranged symmetrically with respect to the vertical line M-O-N passing through the center O of the photoreceptor drum 10. The developing units 13(Y) and 13(K) are also arranged symmetrically with respect to the vertical line M-O-N passing through the center O of the photoreceptor drum 10. The developing units 13(Y) and 13(K) are symmetrically arranged with respect to the center O on the horizontal line passing through the center O. Angle θ1 formed by the lower vertical line O-N and the cleaning unit 19 arranged on the downstream side of the drum rotation is determined to be 5° to 45°. Angle θ2 formed by the lower vertical line O-N and the transfer unit 14*a* arranged on the upstream side of the drum rotation is determined to be 25° to 65°. When the units are arranged in the manner described above, it is possible to integrate the photoreceptor drum 10 and the optical exposure systems 12 (Y, M, C, K) with the scorotron chargers 11 (Y, M, C, K), the cleaning unit 19 and the developing units 13 (Y, M, C, K).

Figure 3:
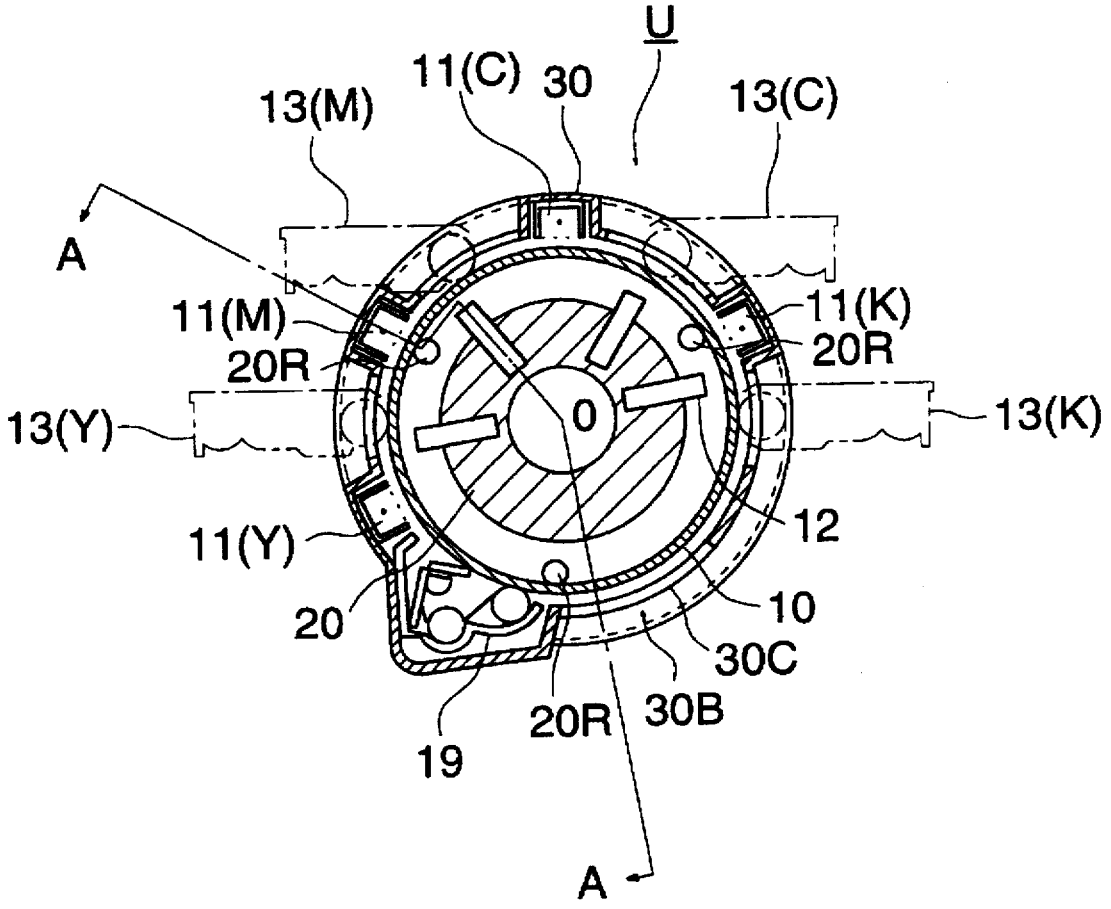
FIG. 3 is a sectional view of the unit of the first example of the first embodiment to accomplish the first object of the present invention.
Figure 4:
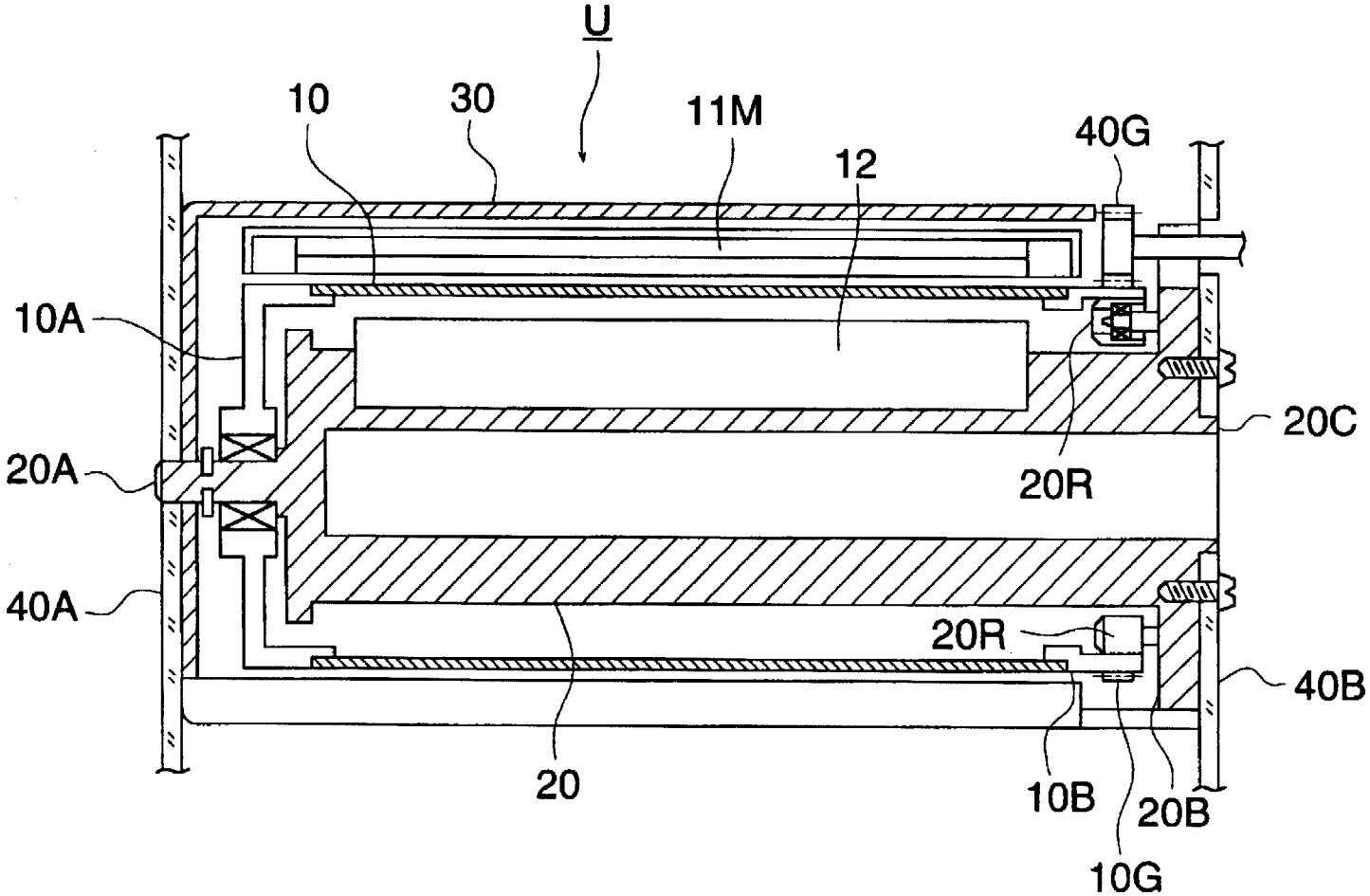
FIG. 4 is a sectional view of the primary portion of the unit descried above.

With reference to FIGS. 3 and 4, the first example of the first embodiment to accomplish the first object of the present invention will be explained as follows.

FIG. 3 is a sectional view of the photoreceptor drum 10 taken on a line in the rotational shaft direction. FIG. 4 is a sectional side view taken on line A-O-A in FIG. 3.

On both sides of the photoreceptor drum 10, there are integrally provided flanges 10A and 10B. The flange 10A is supported through a bearing by a support shaft 20A protruding from the center of a support member 20 of the optical exposure system 12. On the other hand, the flange 10B is rotatably supported by three guide rollers 20R provided in the flange portion 20B of the support member 20.

The photoreceptor drum 10 and the support member 20 are integrally accommodated in a cylindrical protective cover 30 engaged with the support shaft 20A and the flange portion 20B, so that they are integrated into a unit U. The support shaft 20A is engaged with a base plate 40A of the apparatus body, and the engaging portion 20C of the flange portion 20B is engaged with the base plate 40B of the apparatus body. In this way, the support shaft 20A and the flange portion 20B are positioned and fixed.

Consequently, the photoreceptor drum 10 and the optical exposure system 12 are handled as an integrated unit U. As a result, the image formation distance of the optical system can be always maintained constant with respect to the photosensitive layer.

The protective cover 30 integrally accommodates not only the photoreceptor drum 10 but also the chargers 11 and cleaning unit 19. On the circumferential surface 30B of the protective cover 30 formed around the drum surface, there is provided an opening 30C through which the developing unit 13, transfer unit 14B or discharger 14*b* is opposed to the photoreceptor surface.

After the unit U has been attached to the apparatus body, the developing unit 13, transfer unit 14B and discharger 14*b* are installed at predetermined positions.

In this connection, it is also possible to extend the dimensions of the unit U, so that each developing unit 13 can be integrally accommodated in the unit U. Also, it is possible to integrally accommodate only the photoreceptor drum 10 and each optical exposure system 12 in the unit U.

Simultaneously when the unit U is attached to the apparatus body, the gear 10G provided on the outer circumference of the flange 10B of the photoreceptor drum 10 is meshed with the drive gear 40G provided on the apparatus body side, so that the photoreceptor drum 10 is driven through the gears.

Figure 7:
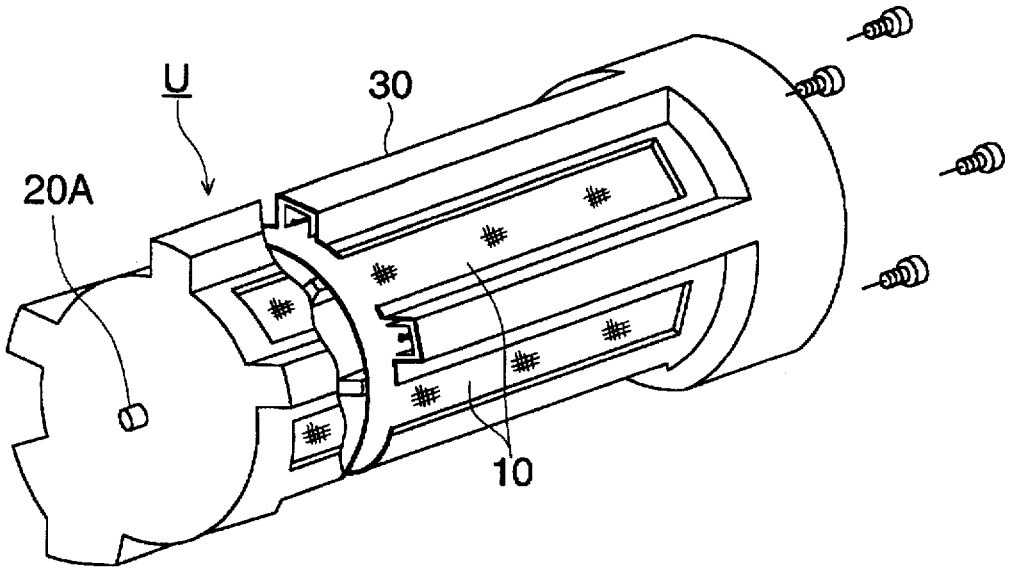
FIG. 7 is a perspective view showing the appearance of the unit shown in FIG. 3.

FIG. 7 is a perspective view showing the appearance of the unit U.

Next, with reference to FIGS. 5 and 6, the second example of the first embodiment to accomplish the first object of the present invention will be explained below.

Figure 5:
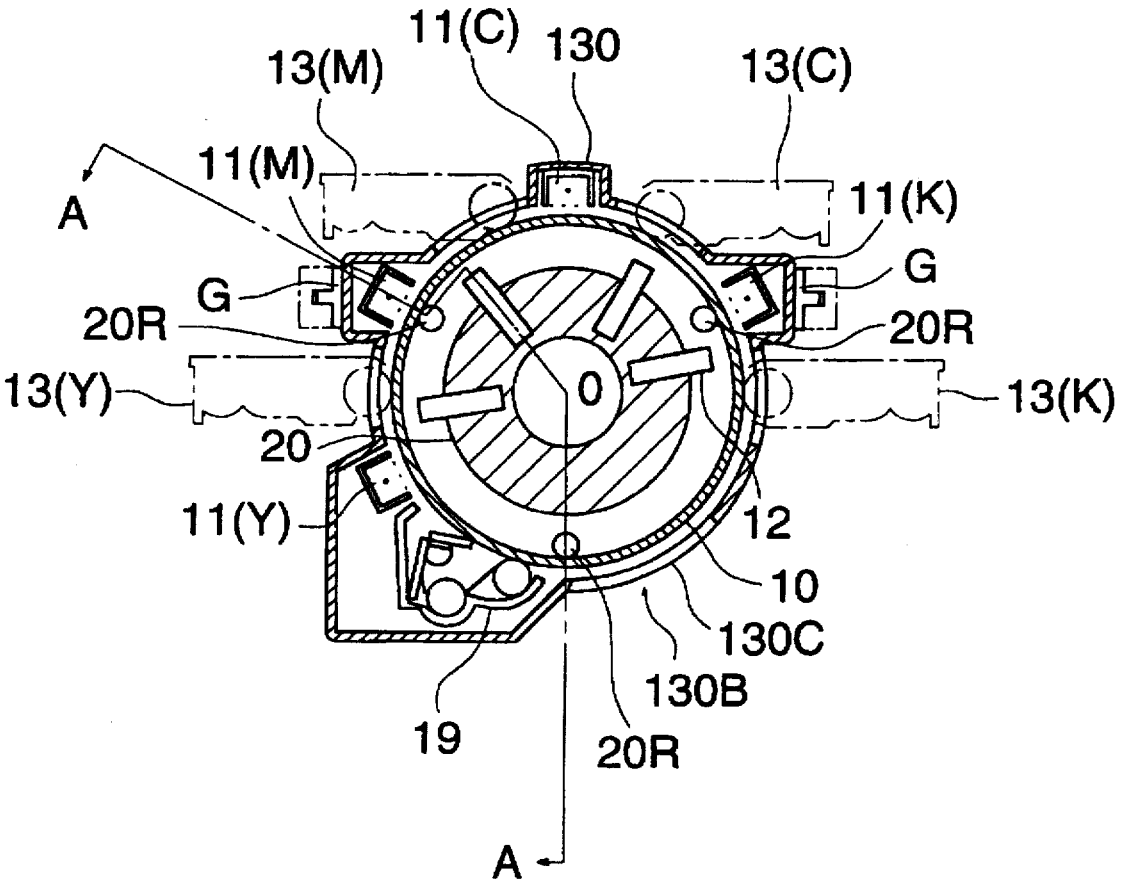
FIG. 5 is a sectional view of the cartridge of the second example of the first embodiment to accomplish the first object of the present invention.
Figure 6:
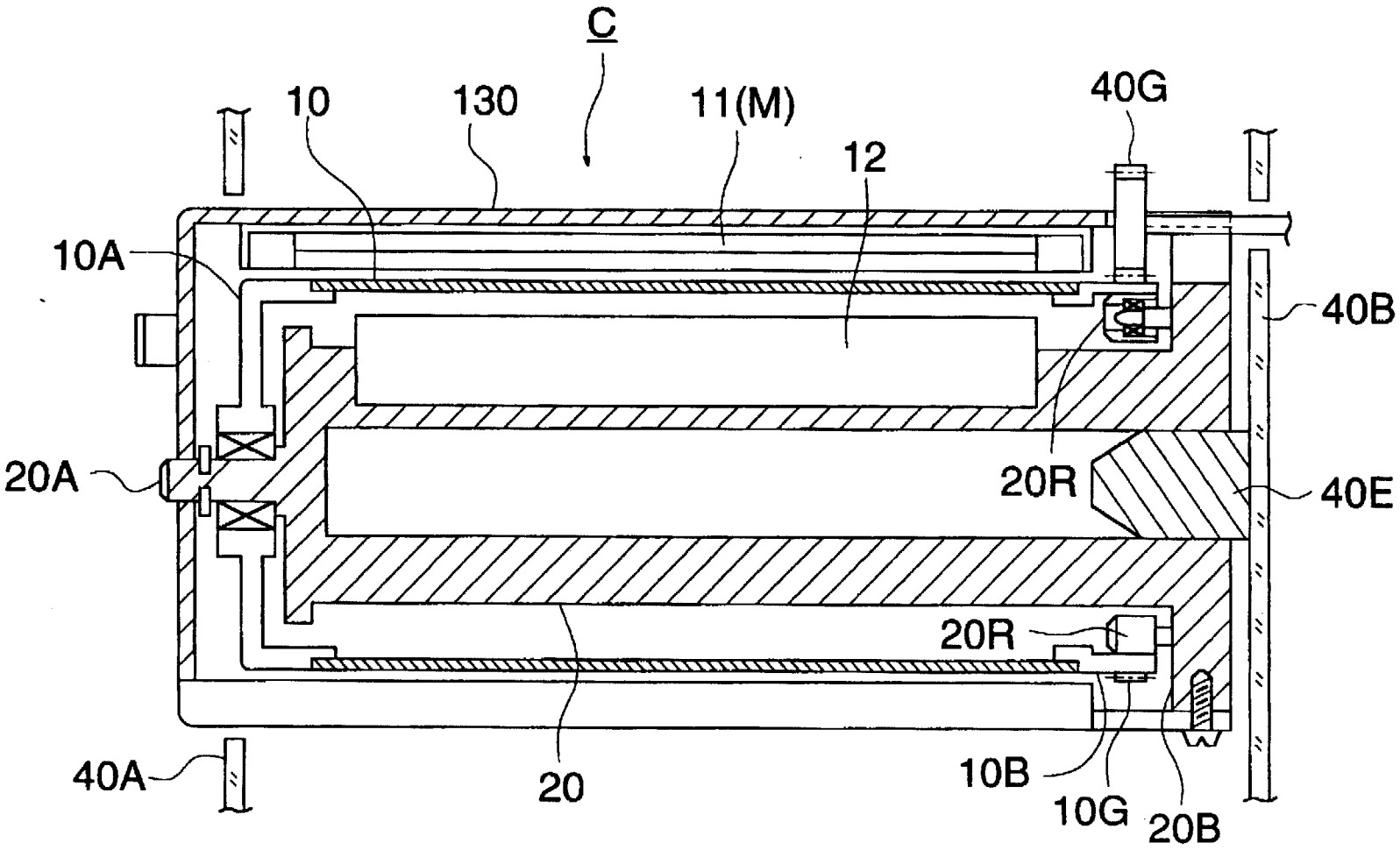
FIG. 6 is a sectional view of the primary portion of the cartridge.

FIG. 5 is a sectional view of the photoreceptor drum 10 taken on a line in the axial direction. FIG. 6 is a sectional side view taken on line A-O-A in FIG. 5.

On both sides of the photoreceptor drum 10, there are integrally provided flanges 10A and 10B. The flange 10A is supported through a bearing by a support shaft 20A protruding from the center of a support member 20 of the optical exposure system 12. On the other hand, the flange 10B is rotatably supported by three guide rollers 20R provided in the flange portion 20B of the support member 20.

The photoreceptor drum 10 and the support member 20 are integrally accommodated in a cylindrical casing 130 engaged with the support shaft 20A and the flange portion 20B, so that they are integrated into a cartridge C. Guide rails G attached on both sides are inserted into guide members (shown by a one-dotted chain line in the drawing) provided on the apparatus body side, and a reference pin 40E is engaged with the cartridge C, and other portions not shown in the drawing are engaged. In this way, the cartridge C is installed at a predetermined position between the base plates 40A and 40B of the apparatus body. When the engaging members described above are released, the cartridge C can be easily picked up from the apparatus.

Accordingly, the photoreceptor drum 10 and the optical exposure system 12 are integrally attached to and detached from the apparatus body in the form of the cartridge C. As a result, the image formation distance of the optical system can be always maintained constant with respect to the photosensitive layer.

The casing 130 integrally accommodates not only the photoreceptor drum 10 but also the chargers 11 and cleaning unit 19. On the circumferential surface 130B of the casing 130 formed around the drum surface, there is provided an opening 130C through which the developing unit 13, transfer unit 14A or discharger 14B is opposed to the photoreceptor surface.

When the cartridge C is attached to or detached from the apparatus body, the developing unit 13, transfer unit 14A and discharger 14B are withdrawn from the photosensitive surface of the photoreceptor drum 10 in order to avoid interference.

In this connection, it is also possible to extend the dimensions of the cartridge C, so that each developing unit 13 can be integrally accommodated in the unit U. Also, it is possible to integrally accommodate only the photoreceptor drum 10 and each optical exposure system 12 in the unit U.

Simultaneously when the cartridge C is attached to the apparatus body, the gear 10G provided on the outer circumference of the flange 10B of the photoreceptor drum 10 is meshed with the drive gear 40G provided on the apparatus body side, so that the photoreceptor drum 10 is driven through the gears.

Figure 8:
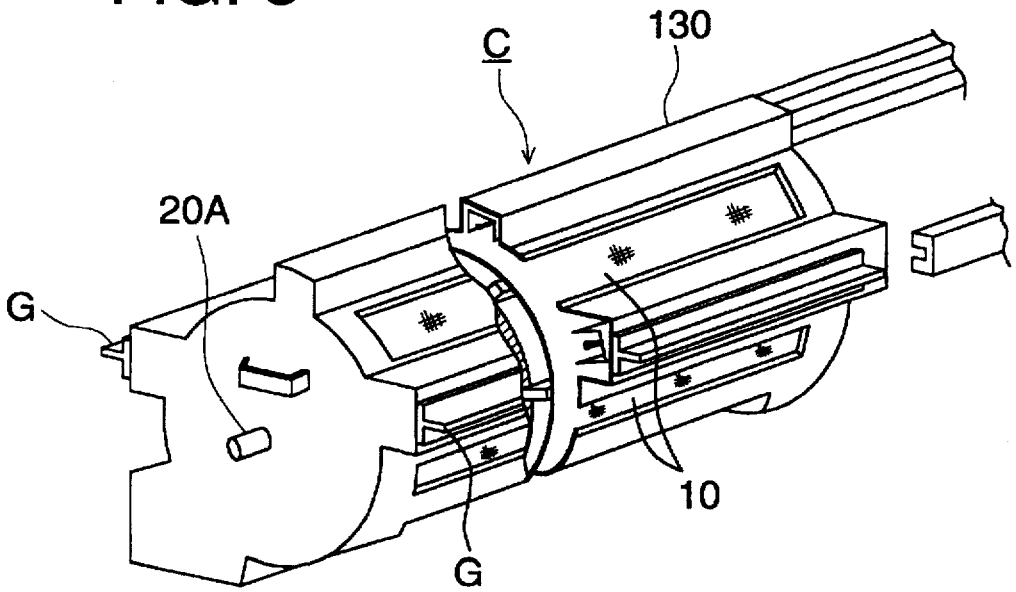
FIG. 8 is a perspective view showing the appearance of the cartridge shown in FIG. 5.

FIG. 8 is a perspective view showing the appearance of the cartridge C.

According to the first embodiment of the present invention, the image forming body and the exposure means are always handled in the form of one unit. Therefore, a positional relation between the image forming body and the exposure means is not varied, and the image formation accuracy of the optical exposure system is maintained to be stable. As a result, it is possible to provide a color image forming apparatus capable of forming an image of high resolution and quality.

In the second embodiment to accomplish the first object of the present invention, the photoreceptor drum 10, the charger 11, developing unit 13 and cleaning unit 19 are integrally accommodated in the cartridge 30. Under the above integrating condition, the cartridge 30 can be attached to and detached from the apparatus body without giving a load or shock to the image exposure means while the support member 20 having the optical system 12 is left in the apparatus body. Due to the above structure in which the support member 20 is left in the apparatus body in the process of attachment and detachment, the heater 201, heat pipe 202, lead 203 (FIG. 9) for operating LED and optical system 12 are maintained to be fixed to the support member 20 even if the photoreceptor drum is rotated, attached or detached. Further, it is possible to use the above structure for determining the axis of the photoreceptor drum 10.

Figure 9:
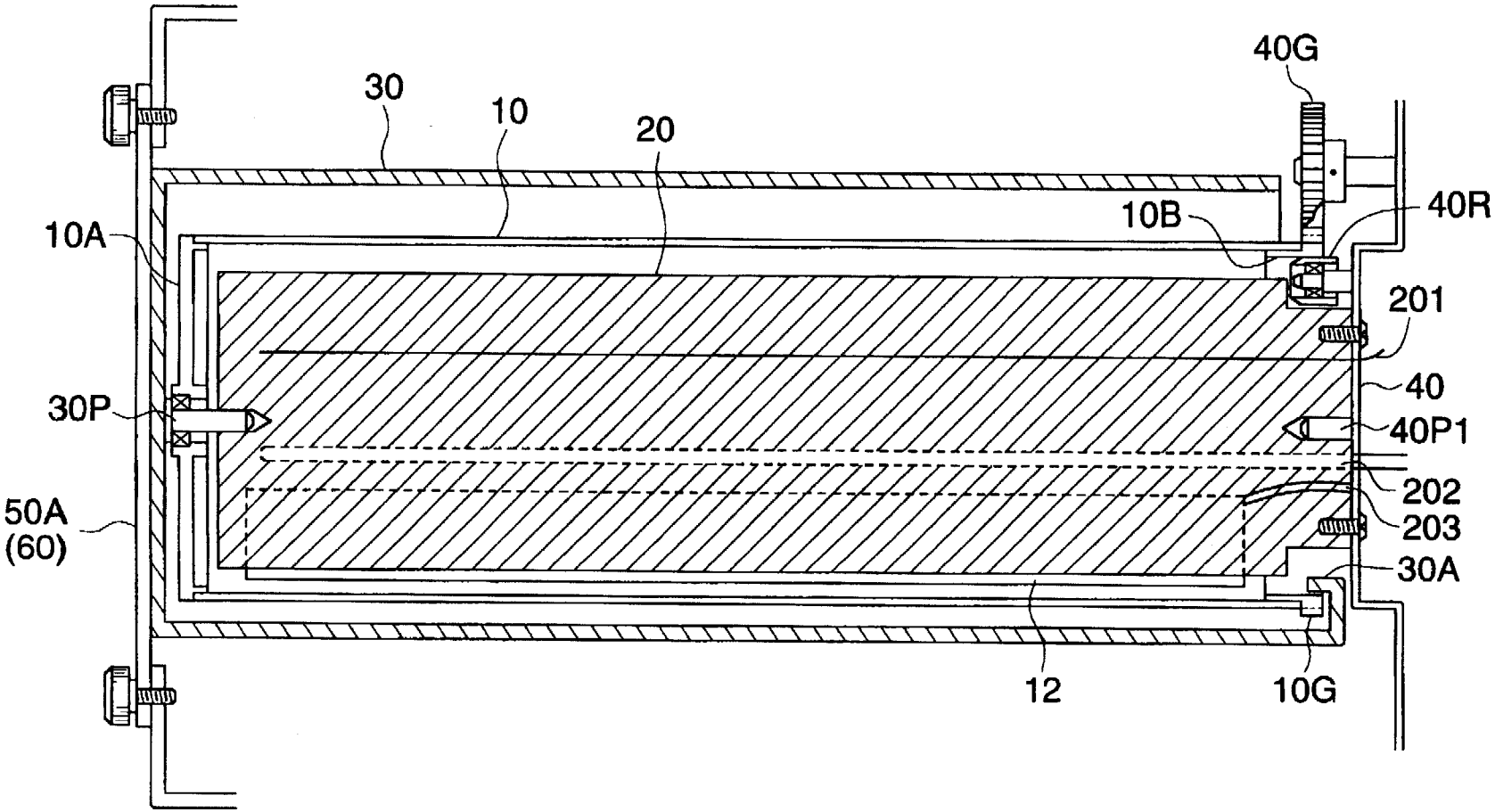
FIG. 9 is a sectional view showing the primary portion for explaining the second embodiment to accomplish the first object of the present invention.
Figure 10:
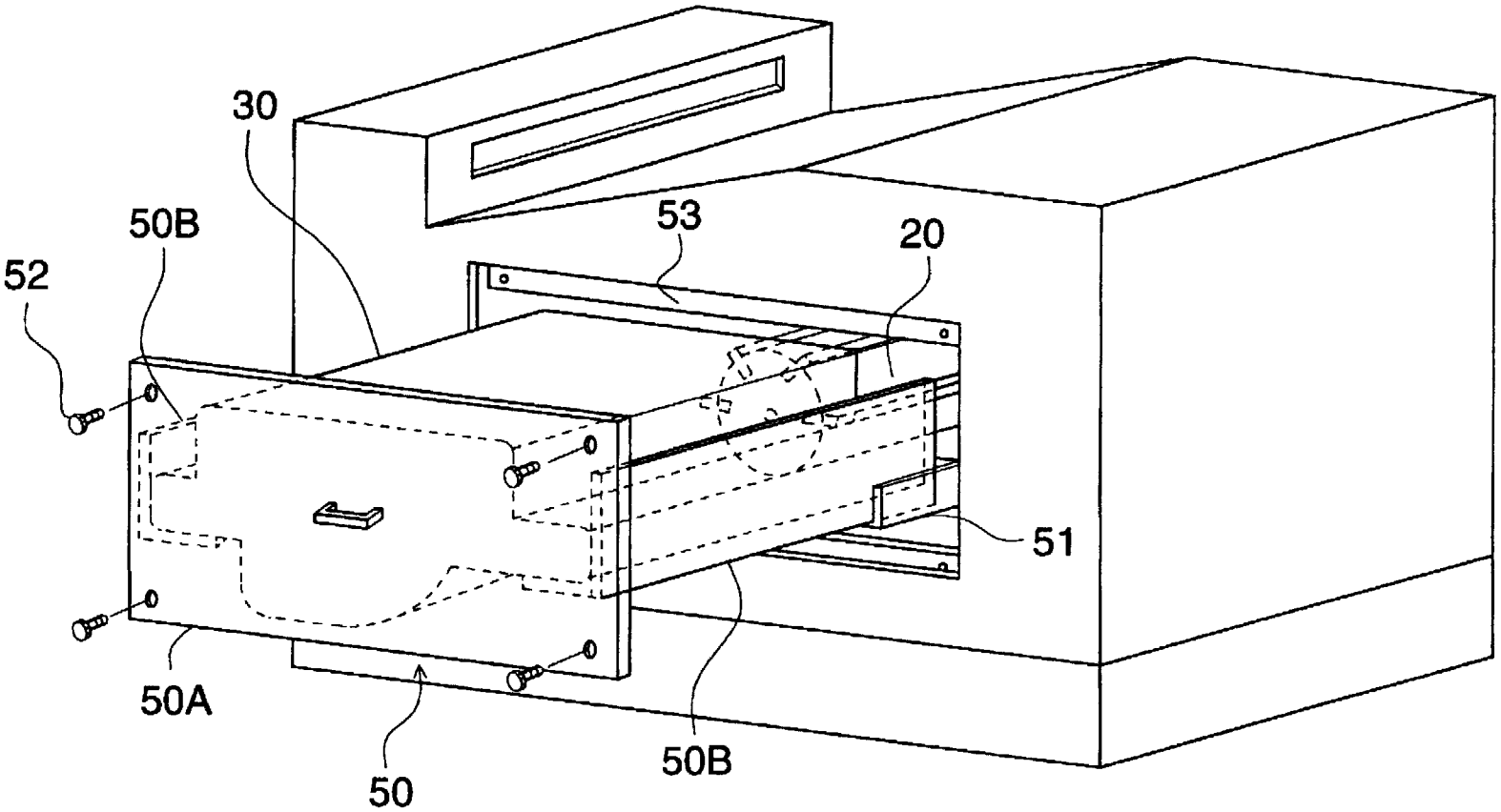
FIG. 10 is a perspective view showing an attaching and detaching system of the cartridge of the first example of the second embodiment.

With reference to FIGS. 9 and 10, the first example of the second embodiment of the present invention will be explained as follows.

The cartridge 30 is accommodated in a frame 50 detachably attached to the side of the apparatus body.

The frame 50 is composed of a side plate 50A and a support mount 50B integrated with the side plate 50A. Under the condition that the cartridge 30 is provided on the frame 50 and further the position is regulated, the frame 50 is horizontally slid along the guide rails 51.

When the frame 50 is inserted into the apparatus, a guide pin 30P for supporting the photoreceptor drum 10 is engaged with the support member 20 for attaching the optical exposure system 12, and then the flange 10B is externally attached to the guide roller 40R on the base plate 40 side, and the side plate 50A is closely contacted with the collision portion 53 of the apparatus body, wherein the screw 52 is used as a fixing means. Due to the foregoing, the center of the photoreceptor drum 10 can be positioned with respect to the image forming section in the axial direction.

When the frame 50 is pulled out from the apparatus body, the photoreceptor drum 10 is released from a position of the support member 20 for attaching each optical exposure system 12, and the slide of the frame 50 is stopped, so that the frame 50 is supported by the guide rails 51.

When the frame 50 is pulled out, the flange 10B of the photoreceptor drum 10 is disengaged from the guide roller 40R and supported by several folding portions 30A formed integrally with the cartridge 30, so that the axial position can be maintained in the same position as that of insertion of the frame 50. Accordingly, when the frame 50 is inserted again, it is easy for the flange 10B to externally engage with the guide roller 40R, so that the axial position of the photoreceptor drum 10 can be maintained at the correct position.

Figure 11:
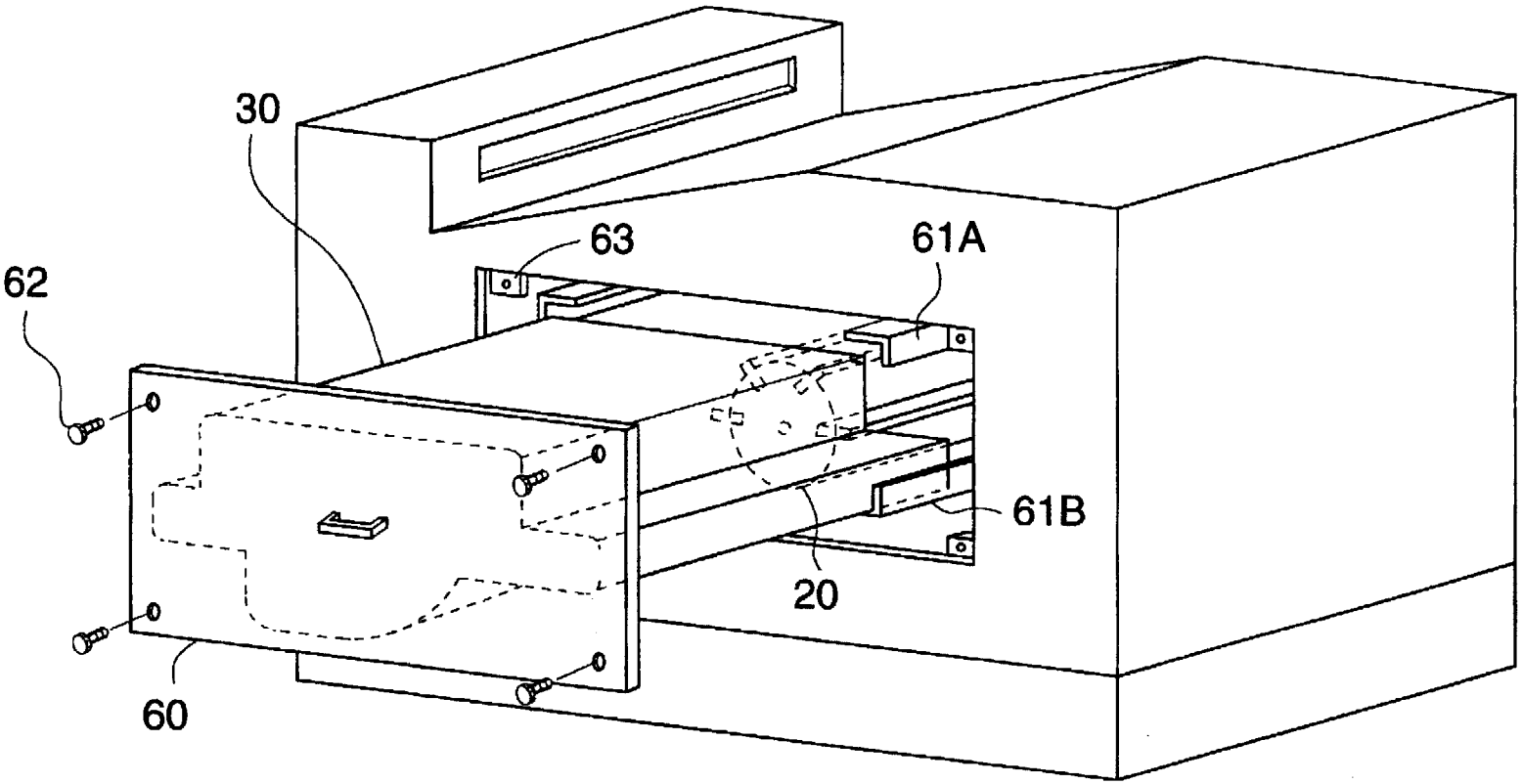
FIG. 11 is a perspective view showing an attaching and detaching system of the cartridge of the second example of the second embodiment.

With reference to FIG. 11, the second example of the second embodiment to accomplish the first object of the present invention will be explained below.

The cartridge 30 has a side plate 60 attached onto a side facing the side portion of the apparatus body. The cartridge 30 is guided by pairs of guide rails 61A, 61B arranged in an upper and a lower position so that the cartridge 30 is slid to be directly attached to or detached from the apparatus body.

At a position where the cartridge 30 is inserted into the apparatus body, the side plate 60 is closely contacted with and fixed to the collision surface 63 of the apparatus body by a plurality of screws 62 used as a fixing means. Due to the foregoing, the center of the photoreceptor drum 10 can be regulated with respect to the image forming section in the axial direction.

When the cartridge 30 is pulled out form the apparatus, at a position where the photoreceptor drum 10 is released from the support member 20 for attaching each optical exposure system 12, the photoreceptor drum 10 is disengaged from the upper guide rail 61A and supported by the lower guide rail 61B protruding forward.

Consequently, when the cartridge 30 is pulled out, the occurrence of drop of the cartridge is prevented, so that it is possible to prevent the photoreceptor drum 10 from colliding with the support member 20. When the cartridge 30 is inserted again, first, it is supported by the lower guide rail 61B. Therefore, it is easy to handle the apparatus, and safety is enhanced.

When the cartridge 30 is pulled out, likewise with the first example shown in FIG. 9, the flange 10B of the photoreceptor drum 10 is disengaged from the guide roller 40R attached to the base plate 40. This flange 10B is supported by several folding portions 30A, so that the cartridge 30 is maintained at an approximately axial center. As a result, when the cartridge 30 is inserted again, the flange 10B is easily engaged with the guide roller 40R, and the photoreceptor drum 10 can be supported in a normal condition.

Concerning the photoreceptor drum 10 of the first and second examples of the second embodiment of the present invention, since the optical exposure system 12 is accommodated in the photoreceptor drum 10, the drum diameter is relatively small, however, it is possible to arrange a plurality of chargers 11 and developing units 13 on the outer circumferential surface of the photoreceptor drum 10. When a small drum, the outer diameter of which is 60 to 160 mm, is used, it is possible to reduce the dimensions of the apparatus.

Figure 12:
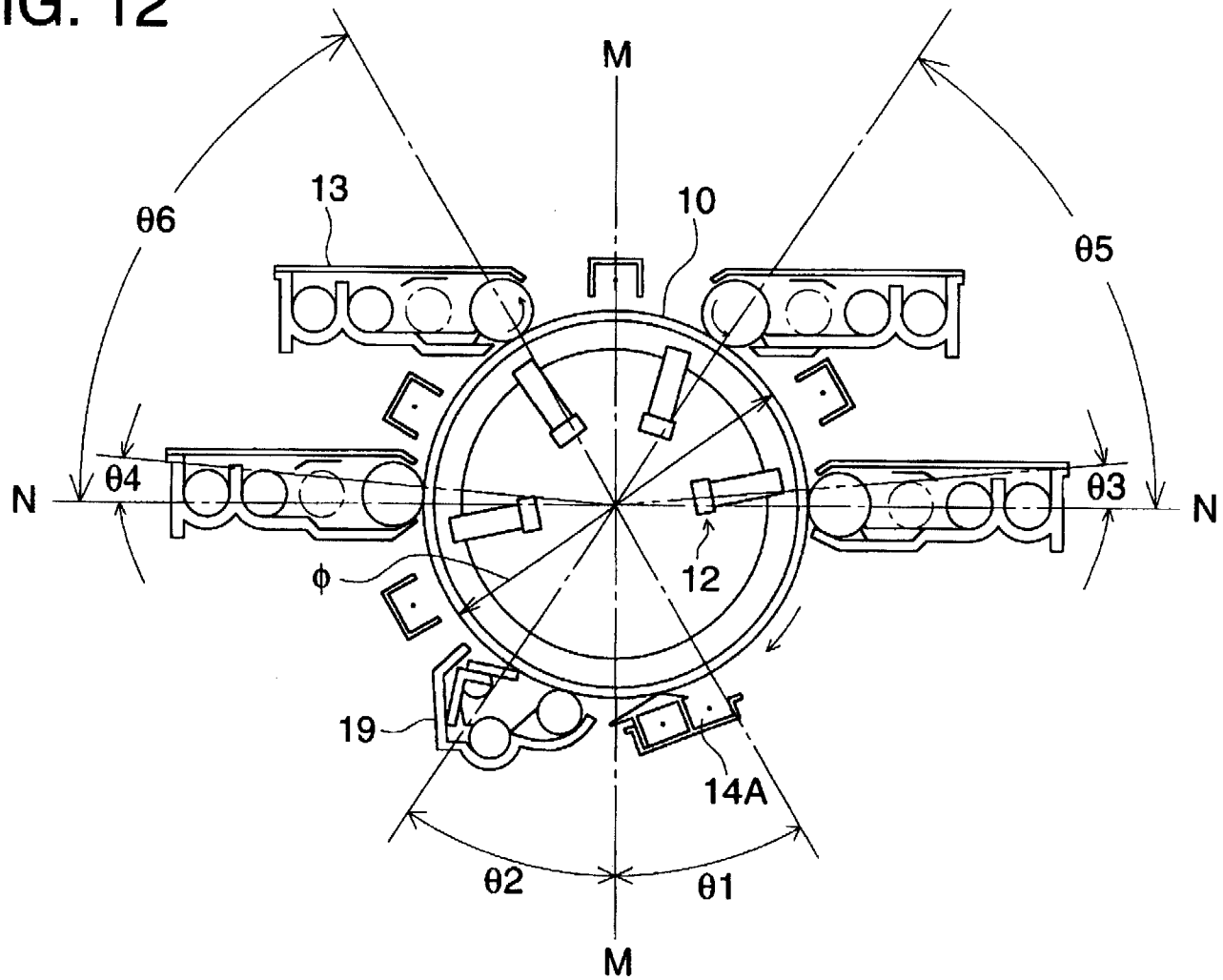
FIG. 12 is an arrangement view showing the layout in the cartridge.

As illustrated in FIG. 12, two optical exposure systems 12 are respectively arranged on the right and left roughly symmetrically with respect to the vertical line M—M passing through the center of the photoreceptor drum 10. Further two developing units 13 are respectively arranged on the right and left symmetrically with respect to the vertical line M—M passing through the center of the photoreceptor drum 10. Further, the transfer unit 14A is arranged on one side, and the cleaning device 19 is arranged on the other side. Due to the above arrangement, the cartridge 30 is composed in a well-balanced condition. Therefore, it is easy to handle it.

As illustrated in FIG. 12, it is possible to effectively use spaces around the photoreceptor and to provide a well-balanced layout when each unit is arranged in the following manner:

The optical exposure system 12 and the developing unit 13 are arranged at positions opposed to each other symmetrically with respect to the vertical line M—M. The transfer unit 14A is arranged under the horizontal line N—N on the upstream side of the rotation of the photoreceptor drum 10 with respect to the vertical line M—M, and the center line of the transfer unit 14A and the vertical line M—M form an angle θ1 of 5° to 40°. On the other hand, the cleaning unit 19 is arranged under the horizontal line N—N on the downstream side of the rotation of the photoreceptor drum 10 with respect to the vertical line M—M, and the center line of the cleaning unit 19 and the vertical line M—M form an angle θ2 of 10° to 50°. A pair of developing units 13 are arranged above the horizontal line N—N, and the center line of the sleeve of each developing unit 13 and the horizontal line N—N form an angle of θ3 or θ4 of ±20°. Further, concerning a pair of developing units 13 arranged in the upper positions, the center line of the sleeve of each developing unit 13 and the horizontal line N—N form an angle of θ5 or θ6 of 45° to 75°.

Figure 13:
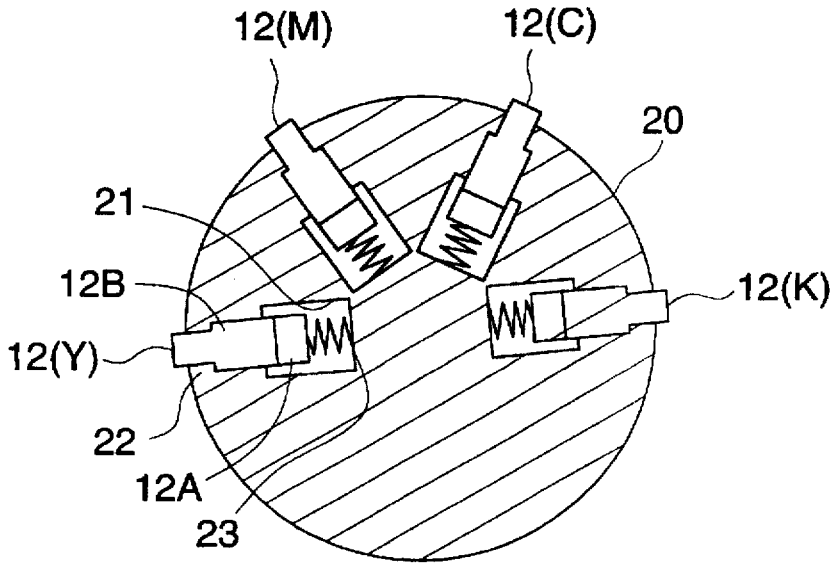
FIGS. 13(*a*) and 13(*b*) are views showing the primary portion of the optical exposure system attaching system of the third example of the second embodiment.
Figure 13:
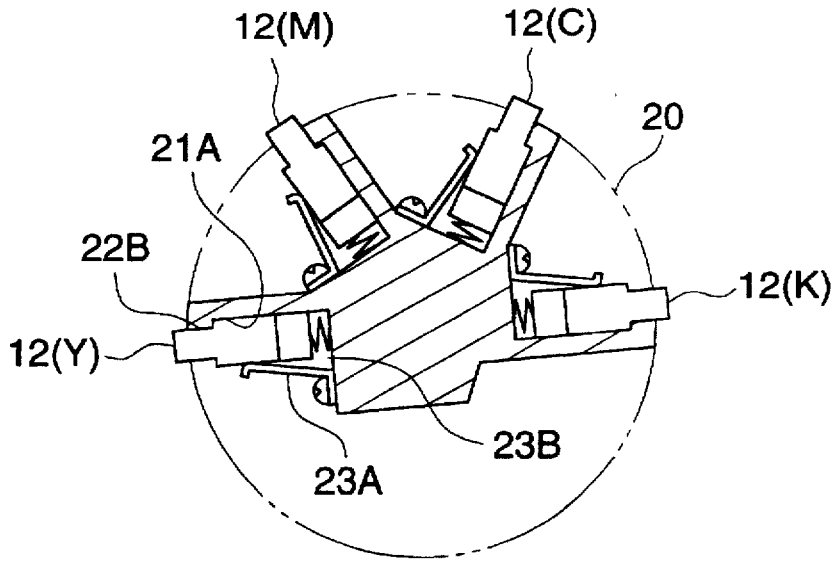

With reference to FIGS. 13(*a*), 13(*b*) and 14, the third and fourth examples of the second embodiment to accomplish the first object of the present invention will be explained as follows.

The optical exposure system 12 includes an LED array 12A linearly arranged in the axial direction of the photoreceptor drum 10 and a Selfoc lens 12B which is a convergence type optical conductor, wherein the LED array 12A and Selfoc lens 12B are integrated into one body. The optical exposure system 12 is attached to the support member 20 in the following manner.

FIG. 13(*a*) is a view showing an example in which the optical exposure system 12 is inserted into an accommodating section 21 provided in the axial direction of the support member 20, and a step portion 22 is formed so that a predetermined clearance can be formed between the optical exposure system 12 and the photoreceptor drum 10, and each optical exposure system 12 is pushed by a compression spring 23.

FIG. 13(*b*) is a view showing an example in which the optical exposure system 12 is pushed by a leaf spring 23A against an attachment surface 21A of the support member 20 provided in the axial direction, and a predetermined clearance between the optical exposure system and the photoreceptor drum 10 is formed by a step portion 22B while each optical exposure system is pushed by a compression spring 23B.

After the cartridge 30 has been removed from the apparatus body, the optical exposure system 12 can be individually detached from the support member 20 so as to be cleaned and maintained.

Figure 14:
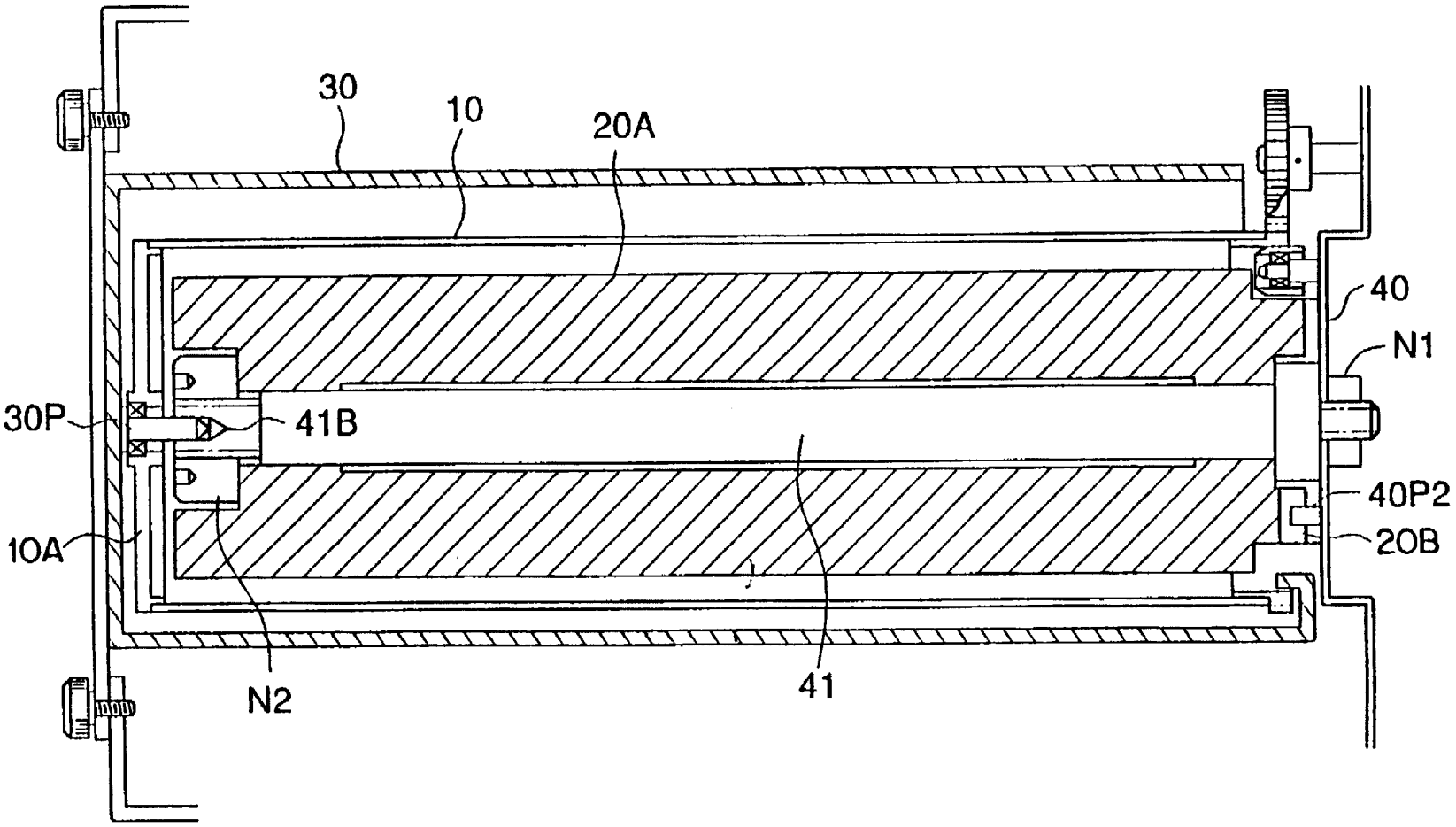
FIG. 14 is a sectional view showing the primary portion of the optical exposure system-support construction of the fourth example of the second embodiment.

FIG. 14 is a view showing an example in which the optical exposure system 12 and the support member 20A can be integrally removed from the apparatus body while the optical exposure system 12 is being supported by the support member 20A. The support member 20A is engaged with a bolt-shaped support rod 41 which is strongly fixed to the base plate 40 by nut N1. A slot 20B is engaged with a reference pin 40P2 of the base plate 40, so that the rotational position is regulated. Then the nut N2 is fastened so that the parts are integrally fixed.

The guide pin 30P supporting the flange 10A of the photoreceptor drum 10 is engaged with an engaging hole 41B formed at the end of the support rod 41. Therefore, the axial center of the drum coincides with the axial center of the support member 20A.

After the cartridge 30 has been pulled out, only when the nut N2 is removed, the support member 20A can be taken out from the apparatus body while each optical exposure system 12 is being attached to the support member 20A. Due to the foregoing, cleaning and maintenance can be effectively carried out. In this case, leads of the heater and the optical system are connected or disconnected by connectors.

As described above, in the second embodiment of the present invention, the color image forming apparatus is composed in such a manner that the exposure means can be inserted into the image forming body. Even in the structure of this second embodiment, in the same manner as that of a common color image forming apparatus, the image forming body can be integrated with the charging and developing means in a well-balanced condition of layout. Therefore, the image forming body can be easily attached to and detached from the apparatus body without giving a load and shock to the image exposure means installed with high accuracy. As a result, a compact and efficient color image forming apparatus can be provided, which can be easily maintained, and the printing speed of which is high.

Figure 15:
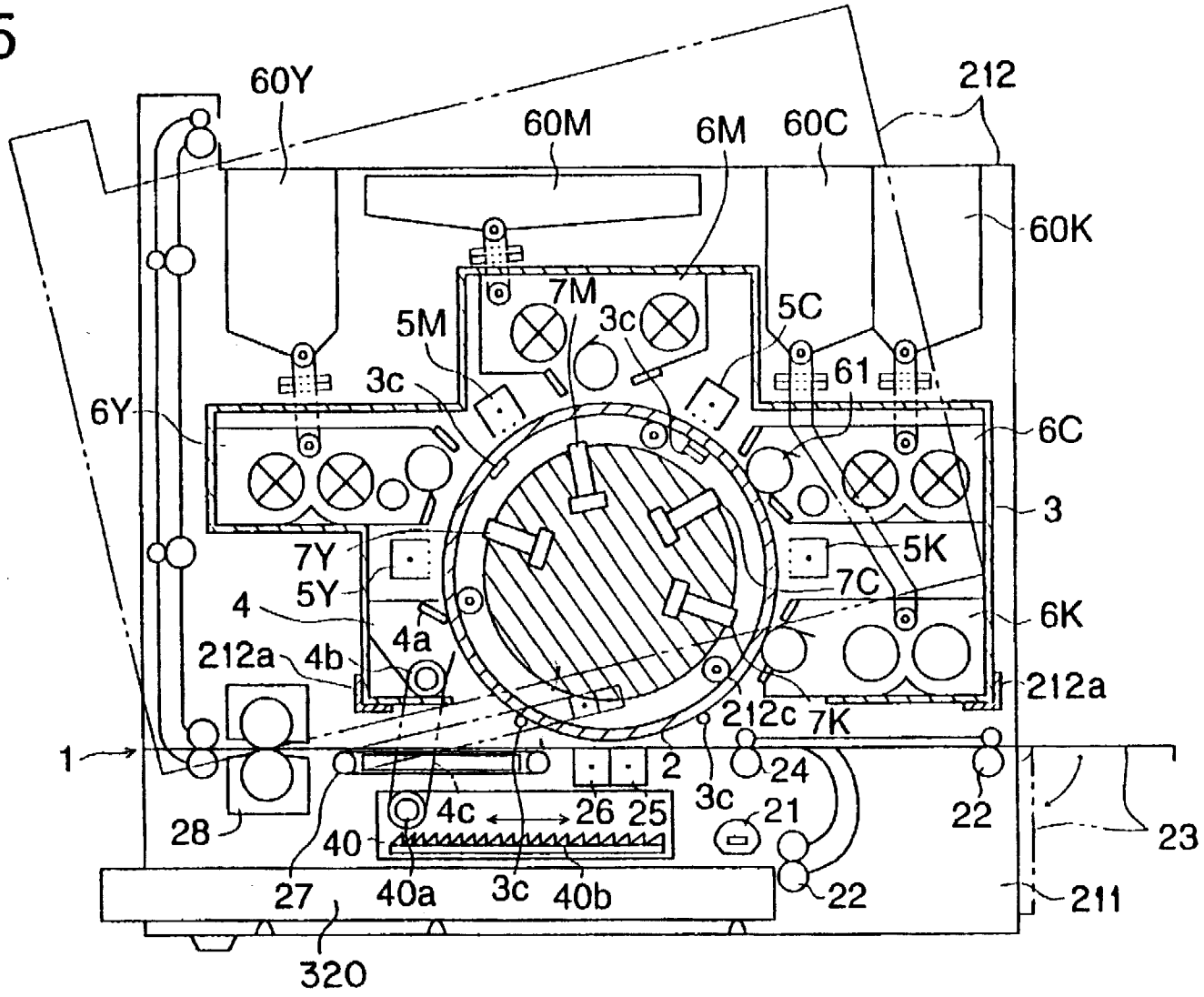
FIG. 15 is a sectional view showing an outline of the color image forming apparatus to which an example to accomplish the second object of the present invention is applied.
Figure 16:
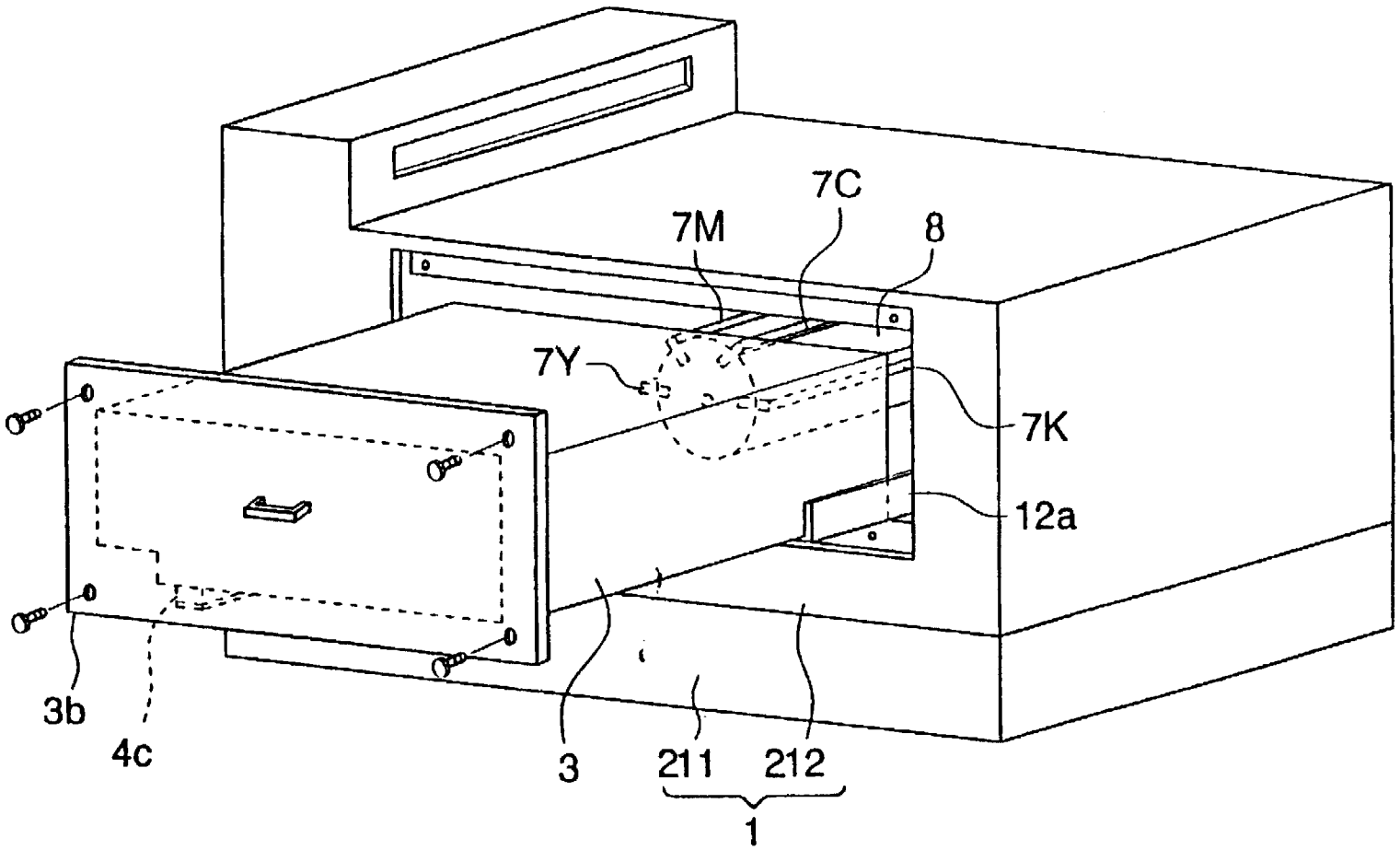
FIG. 16 is a perspective view of the image forming apparatus showing an attaching and detaching condition of the cartridge of the image forming body.
Figure 17:
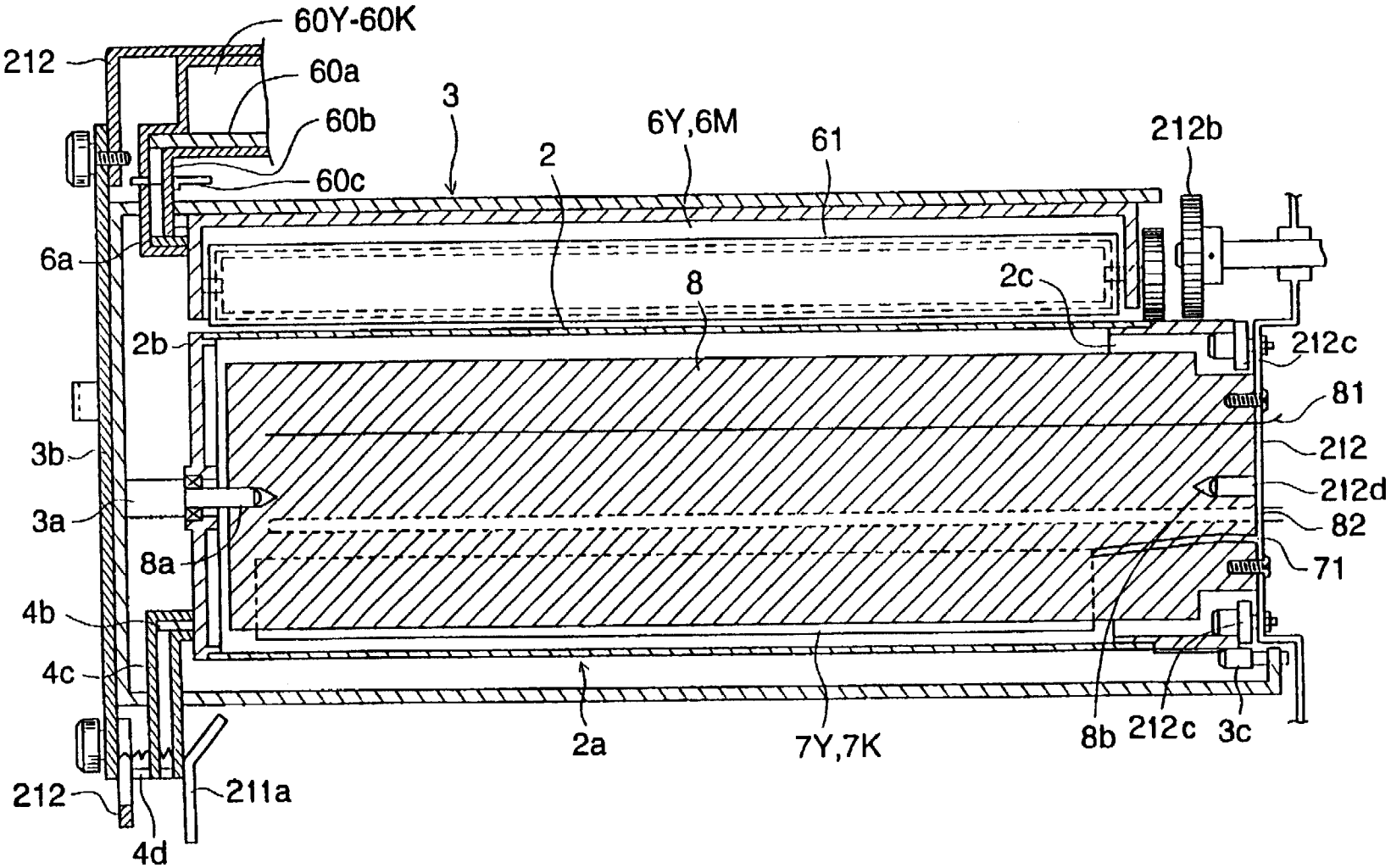
FIG. 17 is a sectional view of the image forming body of the image forming apparatus taken on a line in the axial direction, wherein the view shows a condition in which the cartridge is attached.
Figure 18:
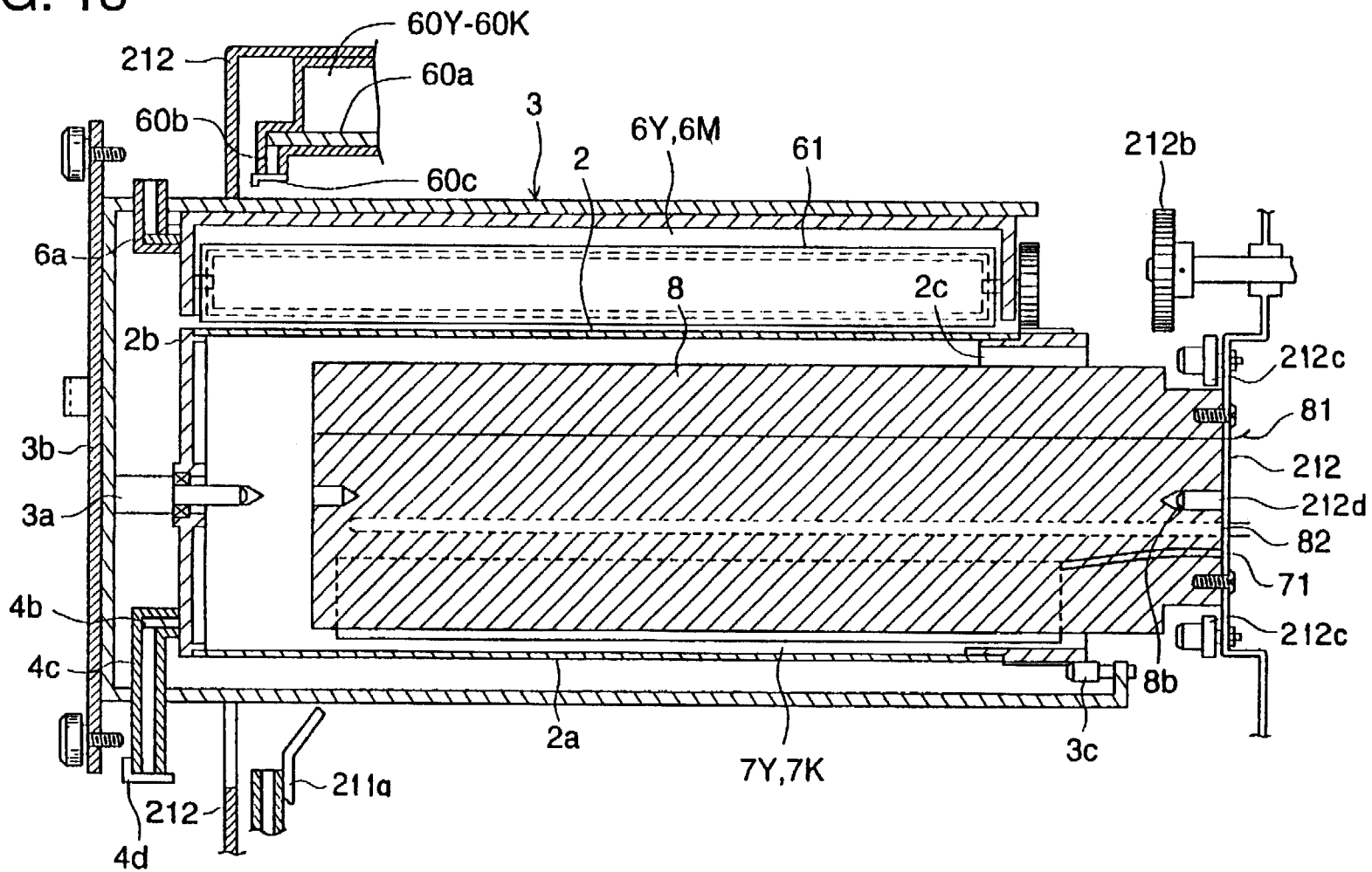
FIG. 18 is a sectional view of the image forming body of the image forming apparatus taken on a line in the axial direction, wherein the view shows a condition in which the cartridge is attached and detached.
Figure 19:
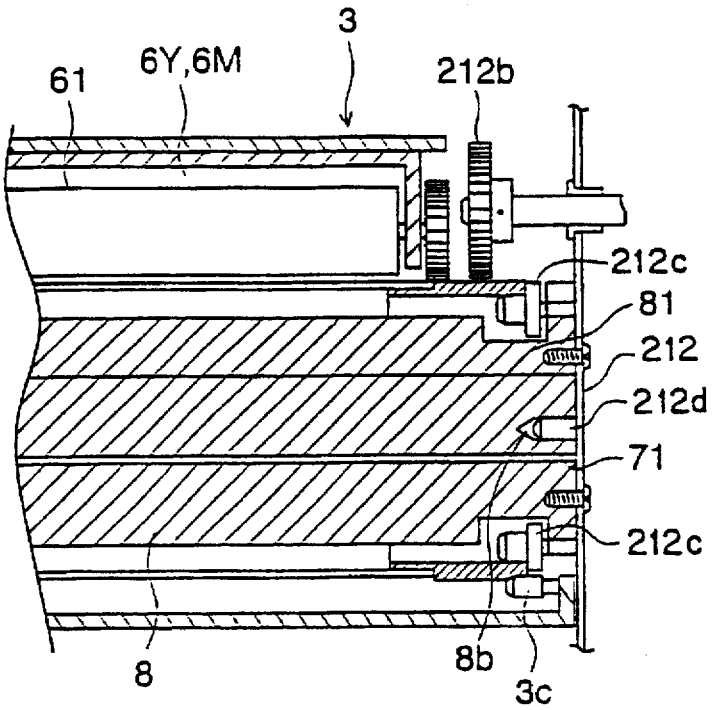
FIG. 19 is a sectional view of the image forming body of the image forming apparatus taken on a line in the axial direction, wherein the view shows an example in which the support means on the open side of the image forming body is different.
Figure 20:
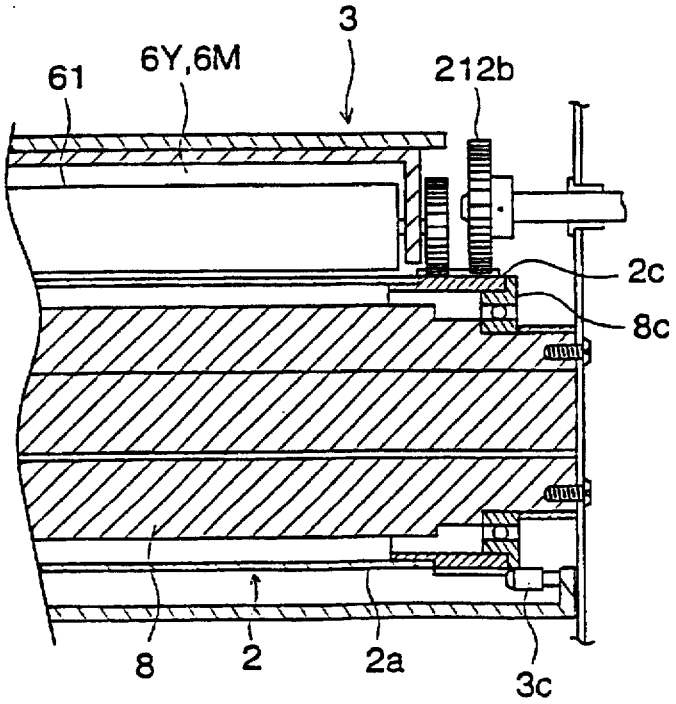
FIG. 20 is a sectional view of the image forming body of the image forming apparatus taken on a line in the axial direction, wherein the view shows an example in which the support means on the open side of the image forming body is different.

FIG. 15 is a sectional view showing an outline of the color image forming apparatus to which an example to accomplish the second object of the present invention is applied. FIG. 16 is a perspective view of the image forming apparatus showing an attaching and detaching condition of the cartridge of the image forming body. FIG. 17 is a sectional view of the image forming body of the image forming apparatus taken on a line in the axial direction, wherein the view shows a condition in which the cartridge is attached. FIG. 18 is a sectional view of the image forming body of the image forming apparatus taken on a line in the axial direction, wherein the view shows a condition in which the cartridge is attached and detached. FIG. 19 is a sectional view of the image forming body of the image forming apparatus taken on a line in the axial direction, wherein the view shows an example in which the support means on the open side of the image forming body is different. FIG. 20 is a sectional view of the image forming body of the image forming apparatus taken on a line in the axial direction, wherein the view shows an example in which the support means on the open side of the image forming body is different.

In FIG. 15, numeral 1 is an apparatus body including a lower frame 211 and an upper frame 212 rotated with respect to the lower frame 211 as illustrated a two-dotted chain line in FIG. 15. Numeral 2 is a drum-shaped image forming body capable of rotating clockwise in FIG. 16, and one end surface of the image forming box is open.

As illustrated in FIGS. 17 and 18, the image forming body 2 includes: a photosensitive cylinder 2*a* made of transparent material such as optical glass or acrylic resin, wherein a transparent conductive layer and an organic photosensitive layer (OPC) are laminated on the outer circumference; a disk member 2*b* integrally connected with one end surface of the photosensitive cylinder 2*a*, the disk member 2*b* being engaged with a bearing; and an annular gear 2*c* press-fitted onto the other end surface of the photosensitive cylinder 2*a*, wherein a gear is formed on the outer circumferential portion protruding from the outside diameter of the photosensitive cylinder 2a. A side of the image forming body 2 onto which the annular gear 2c is provided is an open end surface through which the image exposure means is accommodated in the image forming body.

Numeral 3 is a cartridge frame. The image forming body 2 is inserted into the cartridge frame 3 from the open end side of the cartridge frame 3 while the disk member 2b side takes the lead. A bearing of the disk member 2b is engaged with a shaft pin 3a protruding from the inner face of the cartridge frame 3. An outer circumference on the fore end side of the annular gear 2c is put on a plurality of receiving rollers 3c provided at the inner flange portion of the cartridge frame 3 on the open end side, so that the open end side of the image forming body 2 is supported by the receiving rollers 3c. In this way, the image forming body 2 is supported by the cartridge frame 3. In this connection, as described later, in the case where the cleaning unit and 4 sets of chargers and developing units are assembled into the cartridge frame 3, when the image forming body is inserted into the cartridge frame 3, the cleaning blade and developing units are previously withdrawn so that the cleaning blade and the developing rollers of the developing units are not contacted with the surface of the image forming body 2. The aforementioned shaft pin 3a is fixed on the front plate 3b attached to the cartridge frame 3 at the outside of the disk. The image forming body 2 is inserted into the cartridge 3 by the action of the plurality of receiving rollers 3c.

As described above, the cartridge frame 3 supports the image forming body 2. This cartridge frame 3 is engaged with the guide rail 212a provided in the upper frame 212, so that the cartridge frame 3 is sent into the upper frame 212. When the cartridge frame 3 is sent into the upper frame 212, the annular gear 2c is meshed with the drive gear 212b supported by the upper frame 12. The plurality of supporting rollers 212c directly supported by the upper frame 212 shown in FIGS. 17 and 18 are contacted with the inner circumferential surface of the annular gear 2c. The plurality of supporting rollers 212c supported by the support body 8 connected with the upper frame 212 in FIG. 19 are engaged, and further the supporting means such as a bearing 8c (FIG. 20) attached to the support body 8 is engaged. Further, the surface of the flange step portion of the support means is contacted with the fore end surface of the annular gear 2c. Further, the end surface of the large diameter portion of the shaft pin 3a is contacted with the outside end surface of the bearing inner race of the disk member 2b. When the front plate 3b of the cartridge frame 3 is screwed to the upper frame 212, the above contact conditions are maintained. In this way, the image forming body 2 is attached to the upper frame 212.

In this connection, when the support means is engaged with the inner circumferential surface of the annular gear 2c, the outer circumference of the fore end portion of the annular gear 2c is a little separate from the receiving rollers 3c. In the case of a support means composed of a plurality of support rollers 212c, when the positional phase with respect to the receiving rollers 3c is shifted, the image forming body 2 can be supported while the support rollers 212c are contacted with the outer circumferential surface of the fore end portion of the annular gear 2c. In accordance with the above attachment, the transparent conductive layer of the image forming body 2 is grounded, and the image forming body 2 is rotated clockwise by the drive gear 212b in FIG. 15. In order to remove the image forming body from the apparatus body 1, screws on the front face plate 3b may be removed, and the cartridge frame 3 may be pulled out from the upper frame 212. The cartridge may be attached to or detached from the apparatus body under the condition that the upper frame 212 is open as illustrated by a two-dotted chain line in FIG. 15. In the case where a corona discharger not contacted with the image forming body 2 is used for the transfer means, the cartridge may be attached to or detached from the apparatus body under the condition that the upper frame 212 is closed.

As described above, the image forming body 2 can be easily attached to or detached from the upper frame 212, that is, the apparatus body 1, or alternatively the image forming body 2 can be easily attached to or detached from the cartridge frame 3. Accordingly, the positions of the charger and 4 sets of developing units and image exposure means can be easily and accurately adjusted under the condition that the image forming body 2 has been removed. On the outer circumference of the image forming body 2, there are provided a charger, 4 sets of developing units, a transfer means and a cleaning unit. Inside the image forming body 2, there are provided 4 image exposure means. Accordingly, it is preferable that the outside diameter of the image forming body 2 is not less than 70 mm. In order to make the apparatus compact, it is preferable that the outside diameter of the image forming body 2 is not more than 150 mm.

FIGS. 15 to 18 are views for explaining an example to accomplish the second object. In these figures, the cleaning unit, charger and developing units are integrally assembled into the cartridge and image exposure means is not assembled in the cartridge. In FIG. 15, numeral 4 is a cleaning unit, which is operated as follows:

Prior to the start of rotation of the image forming body 2, the scraper blade 4a comes into contact with the outer circumferential surface of the image forming body 2, and after the stop of rotation of the image forming body 2, the scraper blade 4a is separate from the outer circumferential surface of the image forming body 2. In this way, the residual toner on the outer circumferential surface of the image forming body 2 is removed by the cleaning unit.

Since the cleaning unit 4 is also assembled into the cartridge frame 3, the dimensions of the cleaning unit 4 are reduced in such a manner that toner accumulated in the bottom of the cleaning unit 4 is conveyed outside the wall by the conveyance screw 4b, and the conveyed toner is dropped into the used toner container 40 arranged on the lower frame 11 side. Rotation of the conveyance screw 4b of the cleaning unit 4 assembled into the cartridge frame 3 is transmitted from the annular gear 2c.

Toner that has dropped from the cleaning unit 4 is sent to the used toner container 40 by the conveyance screw 40a of the used toner container 40. In the bottom portion of the used toner container 40, there is provided a reciprocating conveyance plate 40b for conveying the accommodated toner to the inner part. In the case where a cleaning unit 4, the toner accommodating capacity of which is large, is used, it is possible to omit the used toner container 40. It should be noted that the cleaning unit 4 is not limited to the specific example such as a cleaning unit in which a scraper blade is used or a cleaning unit which is assembled to the cartridge frame 3.

Numerals 5Y, 5M, 5C, 5K are scorotron chargers which conduct corona discharge to the outer circumferential surface of the image forming body 2. Numerals 6Y, 6M, 6C, 6K are developing units for developing a static latent image formed on the outer circumferential surface of the image forming body 2 electrically charged by the chargers 5Y, 5M, 5C, 5K. In this case, reversal developing is carried out using two component developer, and toner images of yellow (Y), magenta (M), cyan (C) and black (K) are developed. In this structure, 4 sets of chargers 5Y to 5K and developing units 6Y to 6K are also assembled to the cartridge frame 3. The developing rollers of the developing units 6Y to 6K and the stirring means are driven by the annular gear 2*c* through a clutch means such as an electromagnetic clutch. In order to reduce the dimensions of the developing units 6Y to 6K, the respective toner supply containers 60Y, 60M, 60C, 60K are arranged on the upper frame 212. In the same manner as the conveyance of used toner from the cleaning unit 4 to the used toner container 40, toner is supplied from the toner supply containers 60Y to 60K to the developing units 6Y to 6K by the toner conveyance screw 60*a* on the toner supply container 60Y to 60K side and also by the toner conveyance screw 6*a* on the developing unit 6Y to 6K side. The clutch means is turned on and off and the scraper blade 4*a* of the cleaning unit 4 is contacted and separated by electrical connection and disconnection. This electrical connection and disconnection are made when the cartridge is attached to and detached from the apparatus body, or when operation is manually carried out after the attachment of the cartridge.

In the case where the developer stirring means of the developing units 6Y to 6K are composed of two conveyance screws arranged in parallel with each other in the axial direction, when toner is dropped from the toner supply containers 60Y to 60K to conveyance passages protruding to the sides of the developing units, it is possible to provide toner conveyance screws 6*a* in the developing units 6Y to 6K. The developing units 6Y to 6K may be integrally provided with toner supply tanks. The toner supply tank may not be assembled to the cartridge frame 3, so that the toner supply tank may be directly attached to the upper frame 212. The chargers 5Y to 5K may be directly attached to the upper frame 212.

In the color image forming apparatus illustrated in the drawing, the cleaning unit 4 and four sets of chargers 5Y to 5K and developing units 6Y to 6K are attached to and detached from the upper frame 212 together with the image forming body 2. Accordingly, in the case of detachment, the cleaning unit 4, the dropping pipes 4*c*, 60*b* of the toner supply containers 60Y to 60K, the used toner container 40 and the developing units 60Y to 60K are disconnected from the receiving pipes. In order to prevent toner from scattering from the dropping pipes 4*c*, 60*b*, as illustrated in FIGS. 17 and 18, the cartridge frame 3 is inserted into the attaching position of the image forming body 2, the dropping pipe 4*c* is open while being pushed by the cam 211*a* provided in the lower frame 211 and the receiving pipes of the developing units 6Y to 6K. When the cartridge frame 3 is pulled out from the upper frame 212, the dropping pipes 4*c* are closed by the sliding caps 4*d*, 60*c* pushed by a spring. Even in the case of jam clearance in which the upper frame 212 is open from the lower frame 211 to remove a jammed transfer sheet, the dropping pipe 4*c* is closed so that toner can be prevented from scattering.

In the example illustrated in FIG. 16, the image exposure means is not integrally provided in the cartridge. Numerals 7Y, 7M, 7C, 7K represent optical exposure systems composed of FL, EL, PL and LED in which light emitting diodes are aligned in the axial direction of the image forming body 10, and also composed of LISA, PLZT and LCS in which elements having an optical shutter function are aligned, and also composed of Selfoc lenses serving as a life-size image forming element. These image exposure means are positioned and fixed at the respective positions on the support 8. Accordingly, each setting position can be easily adjusted. Image signals Y, M, C, K that have been read by an image reading apparatus different from the image forming apparatus illustrated in the drawing are successively inputted from the memory to the image exposure means 7Y to 7K. Then the inner circumferential surface of the image forming body 2 charged by the chargers 5Y, 5M, 5C, 5K is exposed to light in accordance with the image signals, so that an electrostatic latent image is formed on the image forming body 2.

In the example shown in FIGS. 16 and 17, the image exposure means 7Y to 7K are attached to the columnar support body 8. The fore end side center hole 8*a* engaged with the shaft pin 3*a* fixed onto the disk portion of the cartridge frame 3 is formed on the fore end surface of the columnar support body 8. The rear end side center hole 8*b* engaged with the center pin 212*d* implanted in the upper frame 212 is formed on the opposite surface. Under the condition that the rear end side center hole 8*b* is engaged with the center pin 212*d* implanted in the upper frame 212, the columnar support body 8 is fixed to the upper frame 212 by means of screws. It is preferable that the engagement is made by not only the center pin 212*d* but also a positioning pin.

After the support body 8 has been fixed, as described before, the cartridge frame 3 is engaged with the guide rails 212*a* provided in the upper frame 212. Then the support body 8 is sent into the upper frame 212. After that, the front plate 3*b* is attached to the upper frame 212. In this way, the support body 8 is inserted into the image forming body 2, and the shaft pin 3*a* is engaged with the center hole 8*a* on the fore end side of the support body 8. Therefore, the image forming body 2 is attached to the support body 8 while the center of the image forming body 2 accurately coincides with the center of the support body 8. In this way, a positional relation between the image exposure means 7Y to 7K and the chargers 5Y to 5K can be accurately set, and also a positional relation between the image exposure means 7Y to 7K and the developing units 6Y to 6K can be accurately set. In this connection, numeral 71 is a lead used for driving each image exposure means 7Y to 7K, numeral 81 is a heater, and numeral 82 is a heat pipe, which will be described later.

Numeral 320 is a sheet feed cassette. Numeral 21 is a frictional feed roller. Numeral 22 is a pinch conveyance roller. Numeral 23 is a manual feed guide. Numeral 24 is a timing roller. Numeral 25 is a transfer unit of the transfer means for charging a transfer sheet to the polarity reverse to that of toner. Numeral 26 is a separator for electrically discharging a transfer sheet onto which a toner image has been transferred so that the transfer sheet is separate from the image forming body 2. Numeral 27 is a conveyor having a suction means for sucking and conveying a transfer sheet separate from the image forming body 2. Numeral 28 is a fixing unit for fixing a toner image onto a transfer sheet by means of a heat roller. The fixing unit 28 and a member provided on the lower frame 11 side are arranged in the lower frame 11.

Under the condition that the upper frame 212 is open as illustrated by the two-dotted chain line in the drawing, the transfer unit 28, separator 26 and conveyor 27 can be rotated around the drive roller shaft of the conveyor 27 on the fixing unit side as illustrated by the two-dotted chain line in the drawing. Due to the foregoing, used toner accumulated in the used toner container can be taken out and disposed.

In the apparatus shown in FIG. 15, color image formation is carried out in accordance with the following process.

Image information that has been read from a document by means of image-pickup elements of the image reading apparatus, or image information compiled by the computer is temporarily stored in the memory as image signals of Y, M, C and K. Next, in accordance with the start of image recording, the image forming body 2 is rotated clockwise in FIG. 1, and the cleaning unit 4 conducts cleaning on the outer circumferential surface of the image forming body 2. Charging is conducted on the outer circumferential surface by the charger 5Y, so that the image forming body 2 is uniformly charged. On the inner circumferential surface of the image forming body 2 that has been electrically charged, image exposure is conducted by the image exposure means 7Y in accordance with the image signal Y inputted from the above memory. In this way, an electrostatic latent image of Y is formed on the image forming body 2. The electrostatic latent image of Y is developed by the developing unit 6Y, and a Y toner image is formed on the outer circumferential surface of the image forming body 2.

Next, the charger 5M conducts charging on the outer circumferential surface of the image forming body 2 on which the Y toner image has been formed. Therefore, the Y toner image surface on the image forming body 2 is uniformly charged. On the inner circumferential surface of the image forming body 2 that has been electrically charged, image exposure is conducted by the image exposure means 7M in accordance with the image signal M inputted from the above memory. In this way, an electrostatic latent image of M is formed on the image forming body 2. The electrostatic latent image of M is developed by the developing unit 6M, and a superimposed image of Y and M are formed on the outer circumferential surface of the image forming body 2.

In the same manner, a C toner image is formed by the charger 5C, image exposure means 7C and developing unit 6C. Further, a K toner image is formed by the charger 5K, image exposure means 7K and developing unit 6K. Therefore, when the image forming body 2 is rotated by one revolution, a four color image is formed on the outer circumferential surface of the image forming body 2.

In this color image forming process, image exposure for forming an electrostatic latent image on the image forming body 2 is conducted by the image exposure means 7Y to 7K. In this case, image exposure is conducted on the inner circumferential surface of the image forming body 2 on which a toner image is not formed. Therefore, the electrostatic latent images are formed under the substantially same condition in which the electrostatic latent image formation is not affected by the toner image. Accordingly, a color image on which colors are well-balanced can be easily provided. In order to prevent the deterioration of life and performance, which is caused by the raised or lowered temperature of the image exposure means 7Y to 7K or the image forming body 2, the support body 8 is made of a thermally conductive material, and the heater 81 and heat pipe 82 are embedded, and when the temperature is low, the heater 81 is activated, and when the temperature is high, the heat pipe 82 is activated so as to be cooled. In order to form a color image on which the colors are well-balanced, a DC developing bias voltage, or a DC and AC developing bias voltage is impressed by a bias voltage source upon the developing sleeve in the process of reversal development conducted by each developing unit. The aforementioned operation is carried out in the same manner as that disclosed in Japanese Patent Publication Open to Public Inspection No. 307307/1993.

A color image formed on the outer circumferential surface of the image forming body 2 as described above is transferred onto a transfer sheet by the action of the transfer unit 25, wherein the transfer sheet is conveyed by a timing roller 24 through the frictional conveyance roller 21 and the pinch conveyance roller 22 from the sheet feed cassette 20 arranged in a lower portion, or alternatively the transfer sheet is conveyed by a timing roller 24 through the pinch conveyance roller 22 from the manual feed guide 23. The transfer sheet onto which the color image has been transferred is separated from the image forming body 2 by the separator 26. Then the transfer sheet is conveyed by the conveyor 27, and the color image is fixed by the fixing unit 28. After that, the transfer sheet is discharged outside of the apparatus. After the separation of the transfer sheet, the residual toner is removed from the outer circumferential surface of the image forming body 2 by the cleaning unit 4 in order to prepare for the next operation.

In the color image forming apparatus of the present invention, the image forming body is inserted into the apparatus body while the open end side takes the lead. Therefore, four image exposure means are received inside of the image forming body from the open end side. When the shaft fixed to the apparatus body is engaged with the bearing of the disk arranged on the opposite side of the image forming body inserting direction, the image forming body is simply attached to the apparatus body. Therefore, when the image forming body is removed, the positional relation between the four image exposure means and the chargers or developing units arranged around the image forming body can be easily adjusted. Further, it is easy to replace the image forming body, cleaning unit, four set of chargers and developing units, and transfer means, and also it is easy to assemble, maintain and replace the four image exposure means provided inside the image forming body.

Incidentally, in FIGS. 15 through 18, as one example to explain the invention, a constitution to attain the second object is applied to the apparatus corresponding to the second embodiment to attain the first object in which the image exposure means is fixed in the housing (the apparatus body) and is not incorporated in the unit including the photoreceptor drum. However, a constitution to attain the second object can be also applied to the apparatus corresponding to the first embodiment to attain the first object.

That is, a construction of the supporting shaft 20A to support the flange section 10A of the photoreceptor drum 10 and the supporting member 20 as shown in FIG. 4 can be replaced with a construction to support with the shaft pin **3*a* as shown in FIG. 17. Further, it may be also possible to support flange section 10B of the photoreceptor 10 on which the gear 10G is formed as shown in FIG. 4 by a plurality of rollers 3*c* as shown in FIG. 17 or to replace the guide rollers 20R with bearing 8*c* as shown in FIG. 20**.

An example to accomplish the third object of the present invention will be explained as follows, wherein the example is applied to the first embodiment to accomplish the first object illustrated in FIG. 1.

Figure 21:
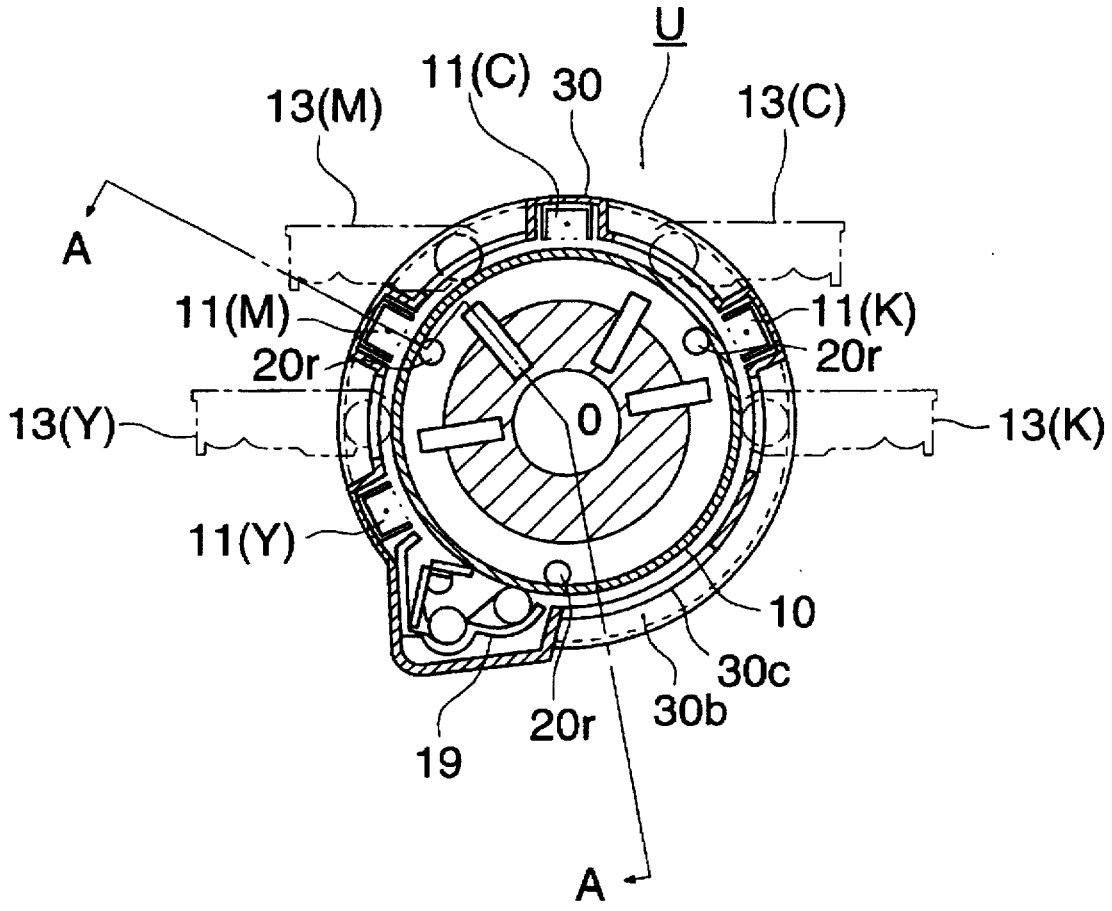
FIG. 21 is a sectional view of the photoreceptor drum taken on a line in the rotational shaft direction for explaining an example to accomplish the third object of the present invention.
Figure 22:
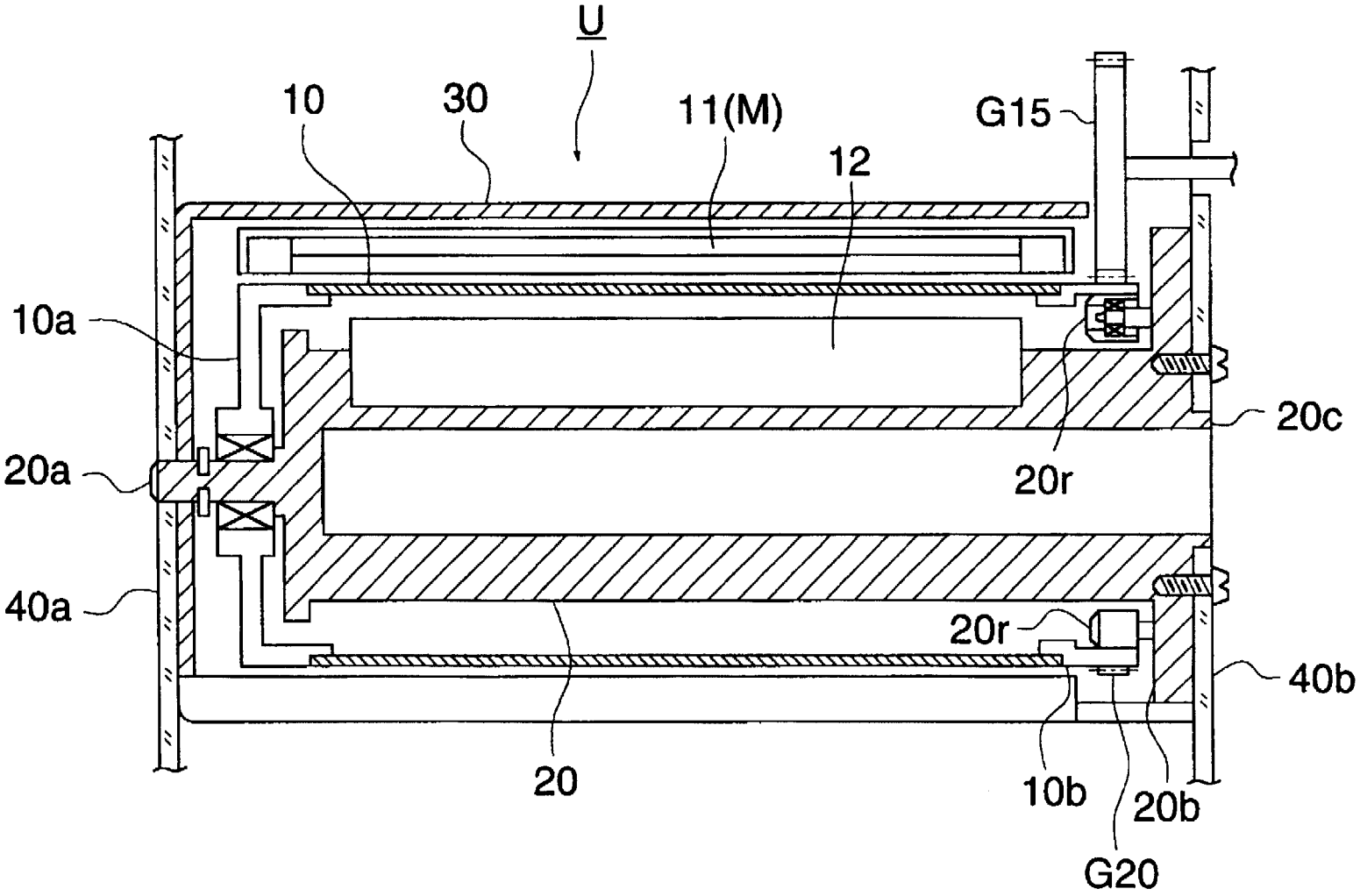
FIG. 22 is a sectional side view taken on line A-O-A in FIG. 21.

As illustrated in FIGS. 21 and 22, flanges **10*a*, 10*b* are integrally attached onto both sides of the photoreceptor drum 10. The flange 10*a* is supported through a bearing by a support shaft 20*a* protruding from the axial center of the support member 20. On the other hand, the flange 10*b* is rotatably supported by 3 guide rollers 20*r* arranged on the flange 20*b* of the support member 20**.

The photoreceptor drum 10 and the support member 20 are accommodated in a cylindrical protective cover 30 engaged with and fixed to the support shaft **20*a* and the flange 20*b* of the support member 20, so that they are integrated into one unit U. The support shaft 20*a* protruding from the front surface is engaged with the base plate 40*a* of the apparatus body, and the engaging section 20*c* at the rear of the flange portion 20b is engaged with the base plate 40b of the apparatus body. In this way, the photoreceptor drum 10 and the support member 20 are positioned and fixed onto the base plate 40b** side by means of screws.

As a result, the photoreceptor drum 10 and the optical exposure systems 12 (Y, M, C, K) are integrally formed into one unit U. Therefore, an image formation distance of the optical system with respect to the photosensitive layer can be always maintained constant.

In the protective cover 30, the scorotron chargers 11 (Y, M, C, K) and the cleaning unit 19 are integrally accommodated together with the photoreceptor drum 10. The inner circumferential surface between the units is formed into a curved surface 30b. On the curved surface 30b, openings are formed so that the developing units 13 (Y, M, C, K), transfer unit 14a and discharger 14b can be opposed to the photoreceptor surface through the openings 30c.

After the developing units 13 (Y, M, C, K), transfer unit 14a and discharger 14b have been attached to the unit U, they are set at the predetermined positions.

It is possible to extend the dimensions of the unit U so as to integrally accommodate the developing units 13 (Y, M, C, K). On the contrary, only the photoreceptor drum 10 and the optical exposure systems 12 (Y, M, C, K) may be integrated.

Simultaneously when the unit U is assembled to the apparatus body, the drum gear G20 provided on the outer circumference of the flange 10b of the photoreceptor drum 10 is meshed with the drum gear G15 provided on the apparatus body side, so that the photoreceptor drum 10 can be driven through the gears.

Figure 23:
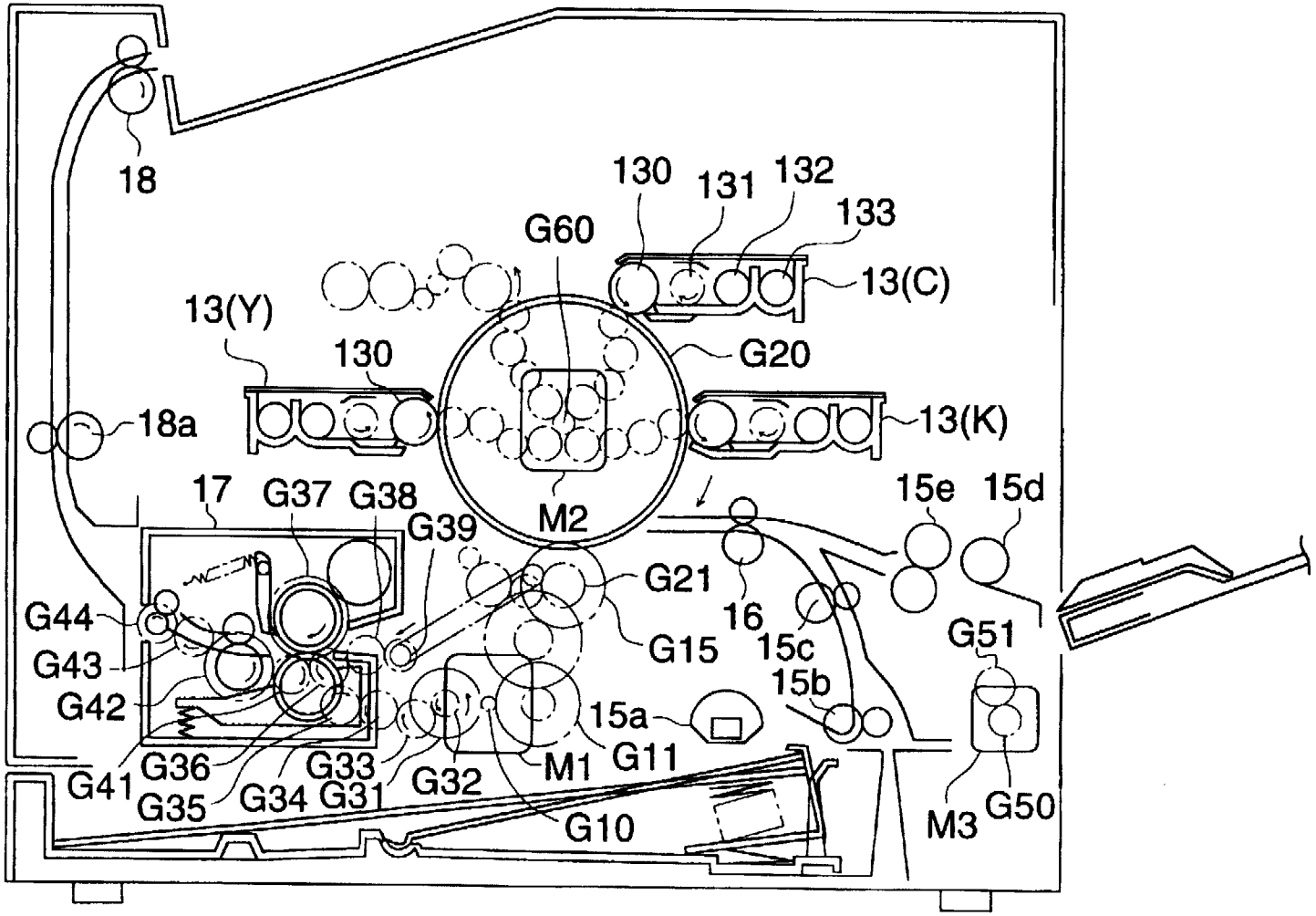
FIG. 23 is a schematic illustration of the drive system of the color image forming apparatus.
Figure 24:
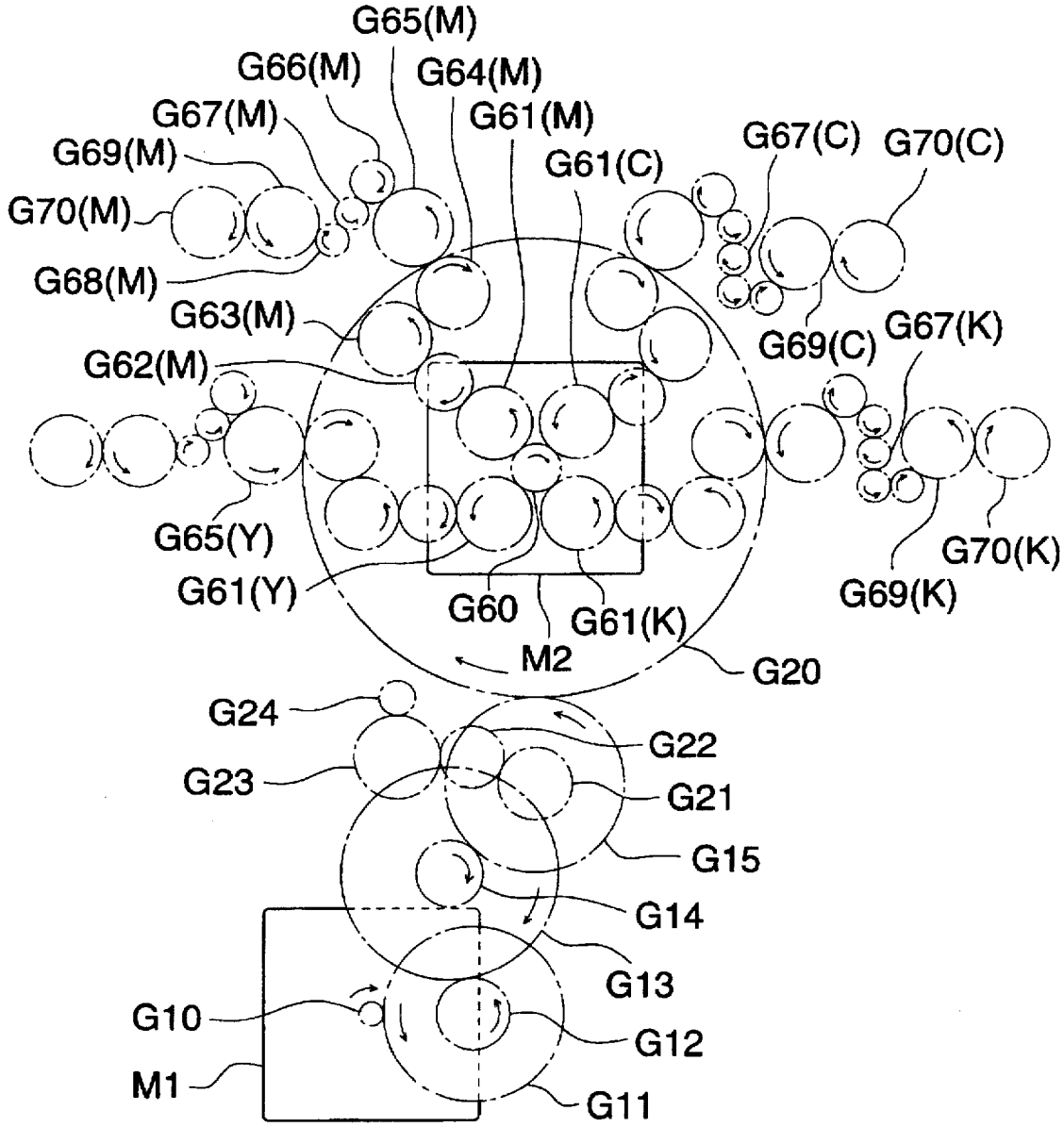
FIG. 24 is a view showing the primary portion of the drive system.

With reference to FIGS. 23 and 24, the drive system will be explained as follows. FIG. 23 is a schematic illustration of the drive system of the color image forming apparatus. FIG. 24 is a view showing the primary portion of the drive system shown in FIG. 3.

M2 is a motor for driving the developing units, and the motor is arranged at the center of the drive shaft of the photoreceptor drum 10. Gear G60 is mounted on the motor shaft and rotated clockwise. When the gear G60 is driven, gears G61, G62, G63 and G64, which are meshed the gear G60, are driven, so that gears G65 (Y, M, C, K) are rotated. Therefore, the developing sleeves 130 (Y, M, C, K) of the developing units (Y, M, C, K) arranged at the same distance from the center of the image forming body, are rotated counterclockwise as illustrated by the arrow in the drawing. When gears G65 (Y, M, C, K) are driven, the developer supply rollers 131 (Y, M, C, K) for supplying developer to the developing sleeves 130 (Y, M, C, K) are rotated by the gears G67 (Y, M, C, K) so that toner can be supplied from the bottoms of the developing units 13 (Y, M, C, K) to the developing sleeves 130 (Y, M, C, K) as illustrated in FIG. 23. Also, the stirring rollers 132 (Y, M, C, K) and 133 (Y, M, C, K) are respectively rotated by gears G69 (Y, M, C, K) and G70 (Y, M, C, K) in the direction shown by the arrow in the drawing. Motor M1 shown in FIG. 24 is a motor for driving the photoreceptor drum 10. Gear G10 mounted on the motor shaft is meshed with the successive gears G11 to G15, and gear G15 is meshed with the drum gear G20 provided on the outer circumference of the flange 10B of the photoreceptor drum 10, so that the photoreceptor drum 10 can be rotated. When gear G21 mounted on the same shaft as that of drive gear G15 is driven, gears G22 to G24 are driven, so that the toner conveyance screw 19b of the cleaning unit 19 is driven by gear G24. As illustrated in FIG. 23, motor M1 for driving the drum drives gear G37 for driving the fixing roller of the fixing unit 17 through gears G31 to G34 meshed with gear G10. Also, motor M1 for driving the drum drives the pressure roller 17b through a pressure roller drive gear not shown in the drawing. Further, a pair of pulling rollers 17c are driven by gear G42 meshed with gear G34, so that a pair of fixing delivery rollers 17d are driven by gear G44. By gear G44, a pair of discharge sheet conveyance rollers 18a and a pair of discharge sheet rollers 18 are driven by gear G44 through belts and gears not shown in the drawing. When gear G34 is driven, the conveyance drive roller 14c is driven by gear G39, so that the conveyance belt 14e provided between the idle rollers 14d can be driven. M3 shown in FIG. 23 is a motor for driving the sheet feed system. When the fixed gear G50 is driven, a roller 15a for feeding transfer sheets from the sheet feed cassette 15, a pair of conveyance rollers 15b, 15b, a timing roller 16, a roller 15d for manually feeding transfer sheets from the manual feed sheet tray 210, and a pair of conveyance roller 15e are driven through a drive system composed of gears and belts not shown in the drawing. In the above drive system, when necessary, a spring clutch or one way clutch is used.

Figure 25:
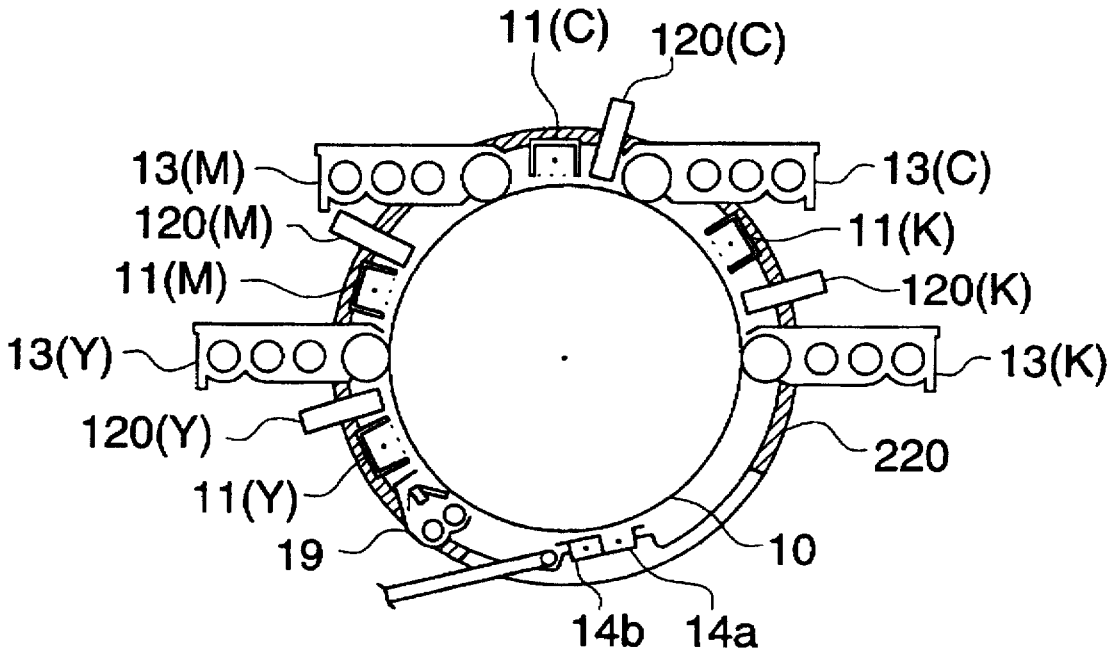
FIG. 25 is a view showing another example of the arrangement of the optical exposure system.

FIG. 25 is an arrangement view showing another example of the optical image exposure system. Optical exposure systems 120 (Y, M, C, K) are arranged outside the photoreceptor drum 10. The optical exposure systems 120 (Y, M, C, K) are attached to a support member 220 fixed to an apparatus body not shown in the drawing so that the photoreceptor drum 10 in the same manner as the example described before. In this case, the process and function of color image formation are the same as those explained in FIG. 1. Therefore, like reference characters are used to indicate like parts in the views.

Figure 26:
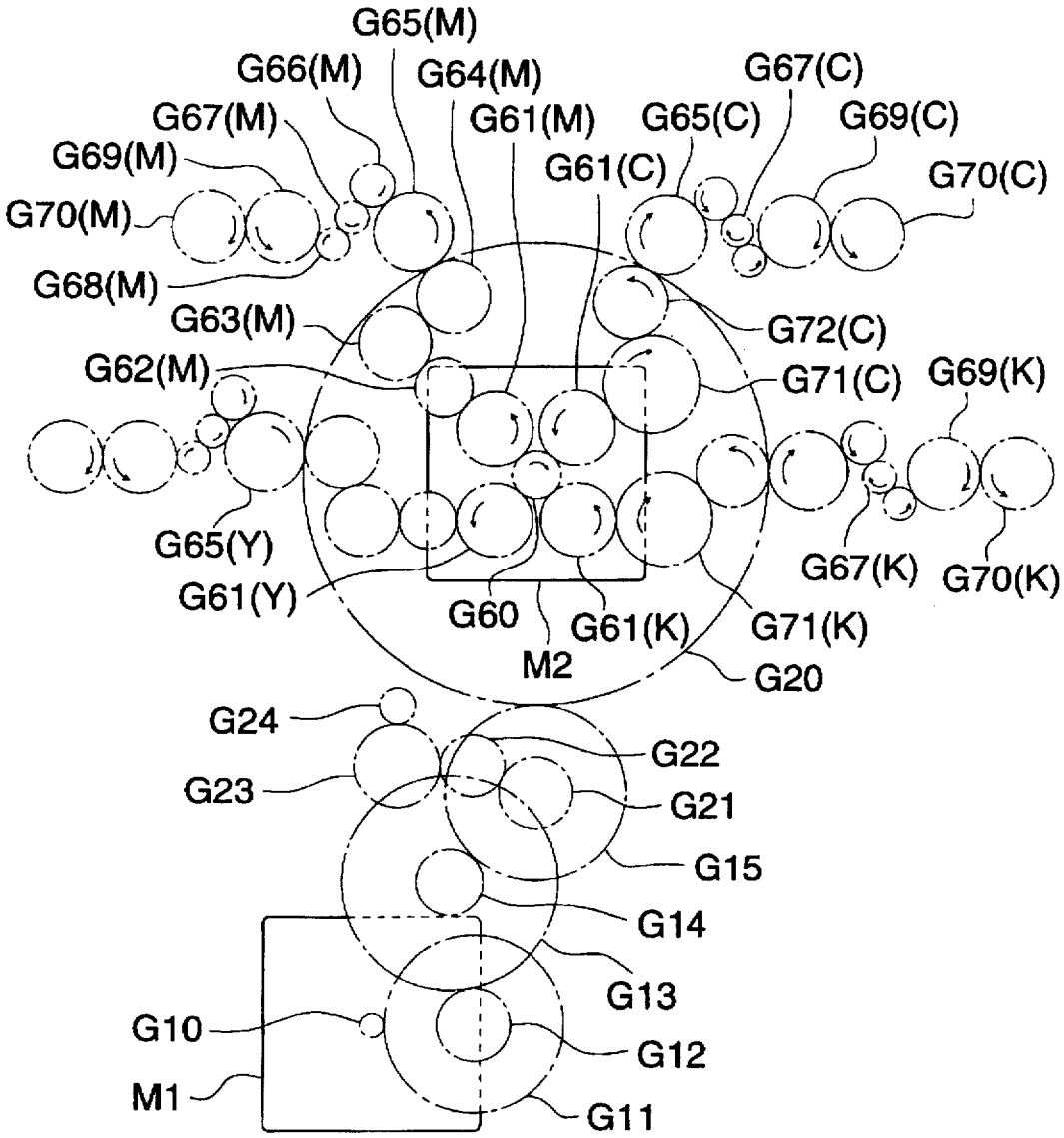
FIG. 26 is a view showing another example of the primary portion of the drive system.

In the above example including the apparatus illustrated in FIG. 24, when the development drive motor M2 is driven, all developing sleeves 130 (Y, M, C, K) of the developing units 13 (Y, M, C, K) are rotated in the same direction, that is, they are rotated counterclockwise. However, as illustrated in FIG. 26 which shows another example of the drive system, it is possible to rotate the developing sleeves 130 (Y, M) of the developing units 13 (Y, M) in the opposite direction to that of the developing sleeves 130 (C, B) of the developing units 13 (C, B), wherein the developing units 13 (Y, M) are arranged symmetrically to the developing units 13 (C, B) with respect to the photoreceptor drum 10. Due to the foregoing, it is possible to make the structure of the developing units 13 (Y, M) to be the same as that of the developing units 13 (C, B).

Figure 27:
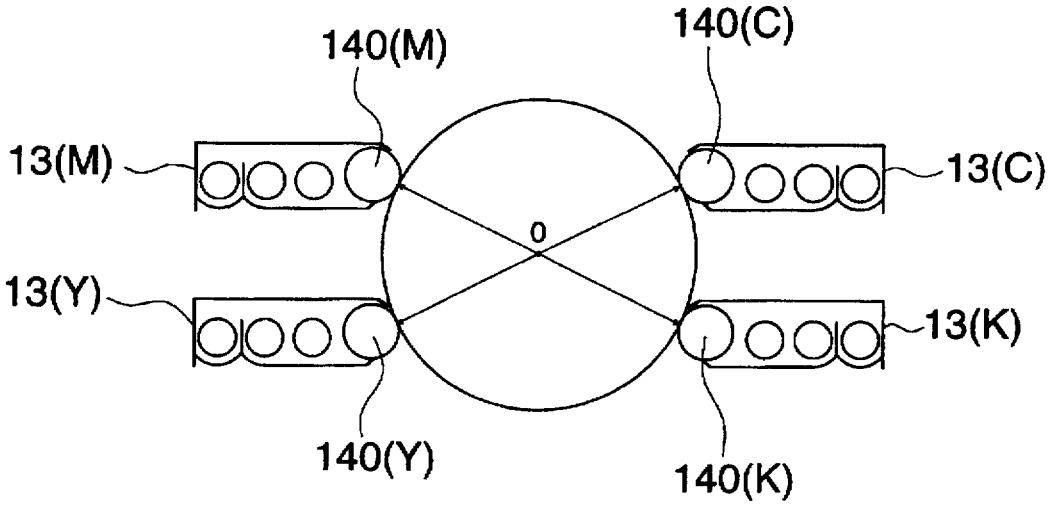
FIG. 27 is a preferable arrangement view of the developing units.

FIG. 27 is an arrangement view showing a preferable arrangement of the developing units. As shown in FIG. 27, the developing sleeves 130(Y) and 130 (C) are arranged on a diagonal line passing through the center O of the photoreceptor drum 10, and also the developing sleeves 130(M) and 130 (K) are arranged on a diagonal line passing through the center O of the photoreceptor drum 10. In the above arrangement, the collision rollers 140 (Y, M, C, K) come into contact with the photoreceptor drum 10 by the same pushing force. Therefore, the photoreceptor drum 10 can be uniformly rotated.

According to the present invention, in the color image forming apparatus in which a charger and plural sets of image exposure means and developing units are arranged in the moving direction of the image forming body, the image exposure means are arranged in the common support body on a concentric circle, and the gear integrated with the image forming body is meshed with the drive gear connected with the drive source arranged outside the image forming body, and further the developing units are operated being meshed with the drive gear of the drive source arranged at the center of the image forming body. Therefore, the drive system is simple and compact, and the image forming body and the developing sleeves are smoothly rotated without causing the fluctuation of rotation. Further, the plurality of developing units are contacted with the image forming body with the same pushing force through the collision .rollers. Therefore, the fluctuation of rotation of the image forming body can be reduced. Accordingly, the accuracy of superimposed images can be enhanced. As a result, it is possible to provide a color image forming apparatus in which image resolution is enhanced so that images of high quality can be formed.

Incidentally, as shown in FIG. 22, as one example to explain the invention, a constitution to attain the third object is applied to the apparatus corresponding to the first embodiment to attain the first object in which the image exposure means is incorporated in the unit including the photoreceptor drum. However, a constitution to attain the third object can be also applied to the apparatus corresponding to the second embodiment to attain the first object in which the image exposure means is fixed in the housing (the apparatus body) and is not incorporated in the unit including the photoreceptor drum.

That is, the gear 10G provided on the outer periphery of the photoreceptor drum 10 in FIG. 9 can be driven by being engaged with a driving gear from the driving source arranged outside of the photoreceptor as shown in a gear arrangement in FIGS. 23 and 24, and the developing devices can be driven by being engaged with driving gears from the driving source arranged on the center of the photoreceptor drum.

Figure 29:
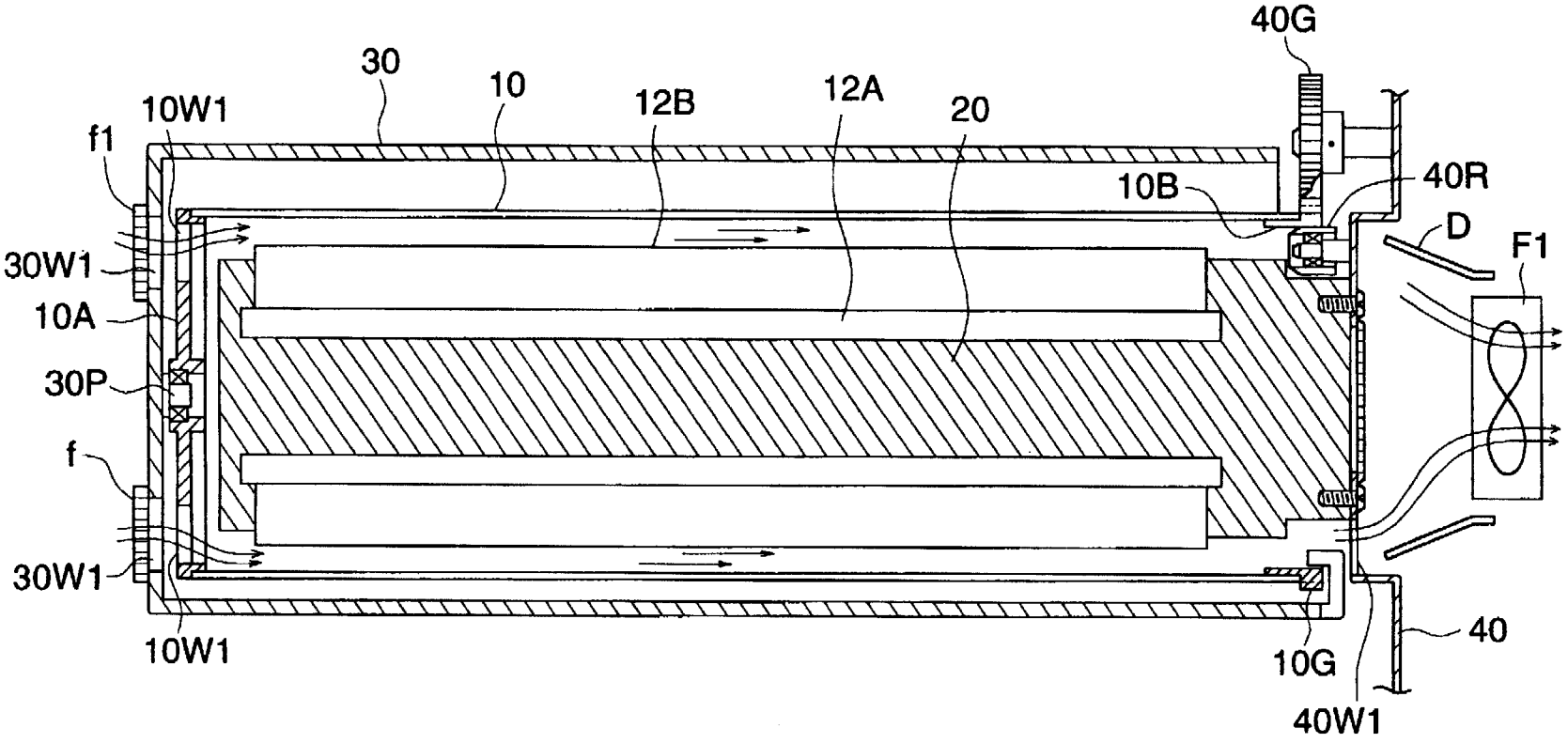
FIG. 29 is a sectional view showing the cooling means inside the photoreceptor of the first example of the first embodiment to accomplish the fourth object of the present invention.
Figure 30:
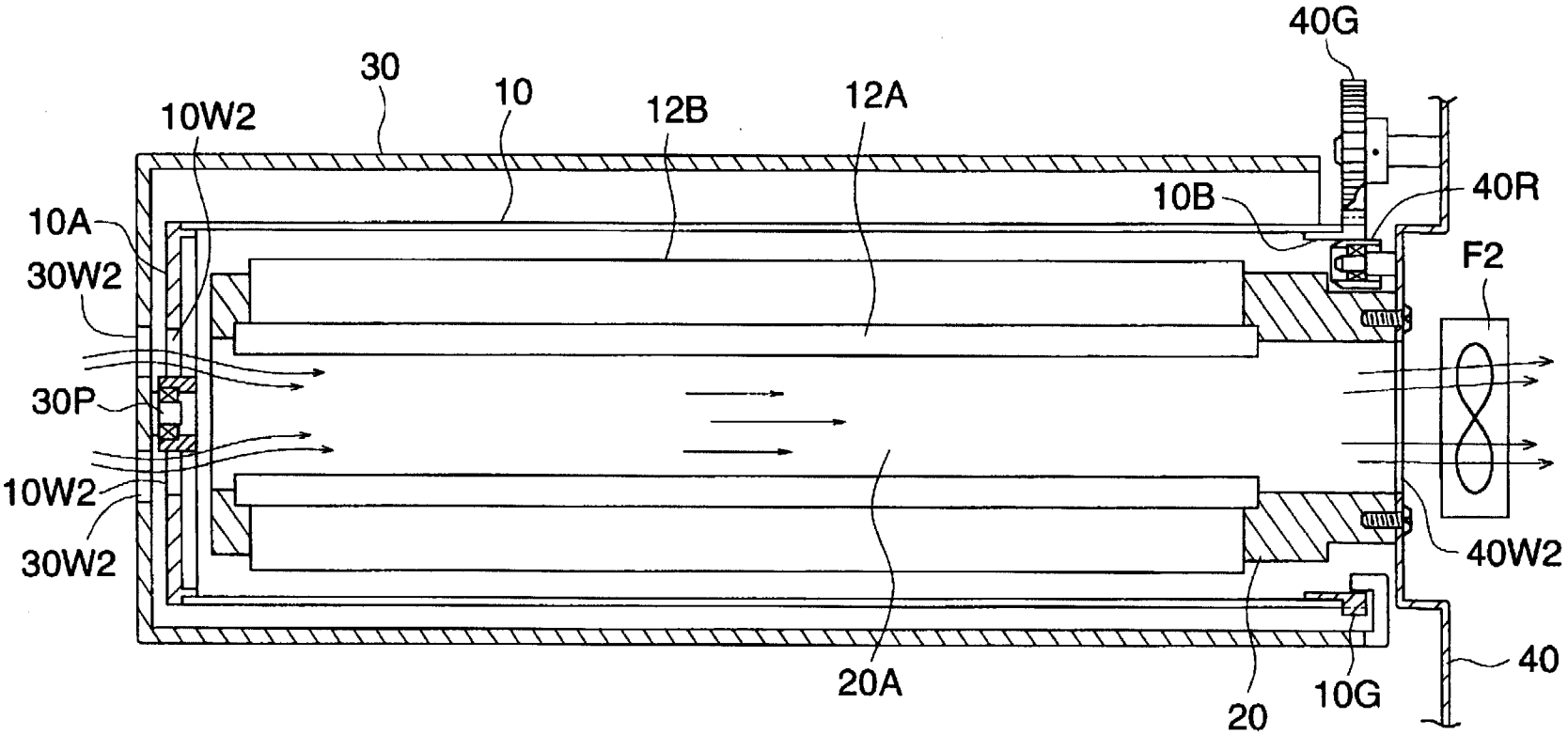
FIG. 30 is a sectional view showing the cooling means provided inside the photoreceptor of the second example of the first embodiment.

With reference to FIGS. 29 and 30, the first embodiment to accomplish the fourth object of the present invention will be explained below.

Figure 28:
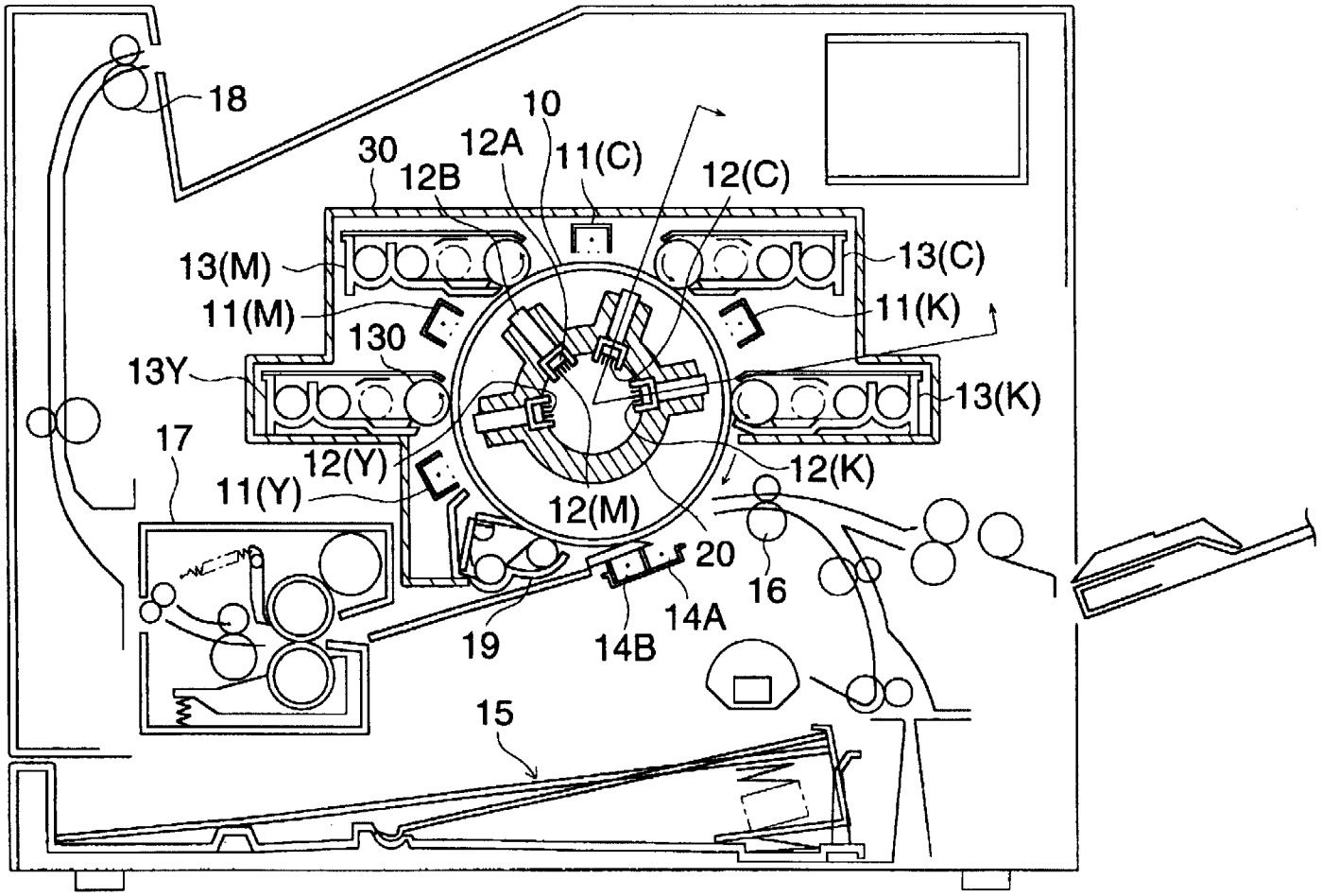
FIG. 28 is a sectional arrangement view showing the color image forming apparatus to which an example to accomplish the fourth object of the present invention can be applied.

FIGS. 29 and 30 are sectional views taken on a line indicated by the arrow on FIG. 28.

In the first example shown in FIG. 29, the flange 10A is provided with a plurality of suction holes 10W1. A plurality of air inlets 30W1, the dimensions of which are little larger than those of the suction holes 10W1, are formed on the side of the cartridge 30 being opposed to the suction holes 10W1.

On the other hand, a plurality of exhaust holes 40W1 are formed on the base plate 40 around the support member 20 fixed to the base plate 40. Propeller fan F1 is installed at the rear of the base plate 40.

The above propeller fan F1 is rotated in accordance with a signal sent from the sensor for detecting the temperature in the photoreceptor drum 10. By the suction of the propeller fan F1, air provided outside the cartridge 30 is sucked into the suction hole 10W1 through the air inlet 30W1. In this way, an air current is formed in the axial direction of the drum in a cylindrical space between the inside of the photoreceptor drum 10 and the outside of the optical exposure system 12.

The air current absorbs the generated heat when it passes outside the optical exposure system 12. By the action of the propeller fan F, air is discharged from the exhaust hole 40W1 of the base plate 40 to the outside of the apparatus through duct D.

Accordingly, an excessive increase of temperature of the photoreceptor drum 10 and the optical exposure system 12 can be prevented and the temperature can be maintained in a range appropriate to exhibit the performance.

An air current sucked into the photoreceptor drum 10 is filtered by a filter f1 provided at the air intake hole 30W1 of the cartridge 30. Therefore, the Selfoc lens 12B can be cleaned by the filtered cleans air current.

In the second example illustrated in FIG. 30, a plurality of suction holes 10W2 are provided around the shaft portion of the flange 10A, and at the positions opposed to the suction holes, a plurality of air intake holes 30W2, the dimensions of which are a little larger than those of the suction holes 10W2, are provided on the side of the cartridge 30.

The support member 20 has a hollow portion 20A at the center. LED 12A of each optical exposure system 12 protrudes from the peripheral surface of the hollow portion 20A. Propeller fan F2 is arranged at the rear of the exhaust hole 40W2 formed on the base plate 40.

An air current formed in the hollow member 20A of the support member 20 directly cools LED 12A of each optical exposure system. On the other hand, an air current formed between the photoreceptor drum 10 and the support member 20 absorbs heat on the drum surface and cleans the surface of the Selfoc lens 12B of each optical exposure system.

Figure 31:
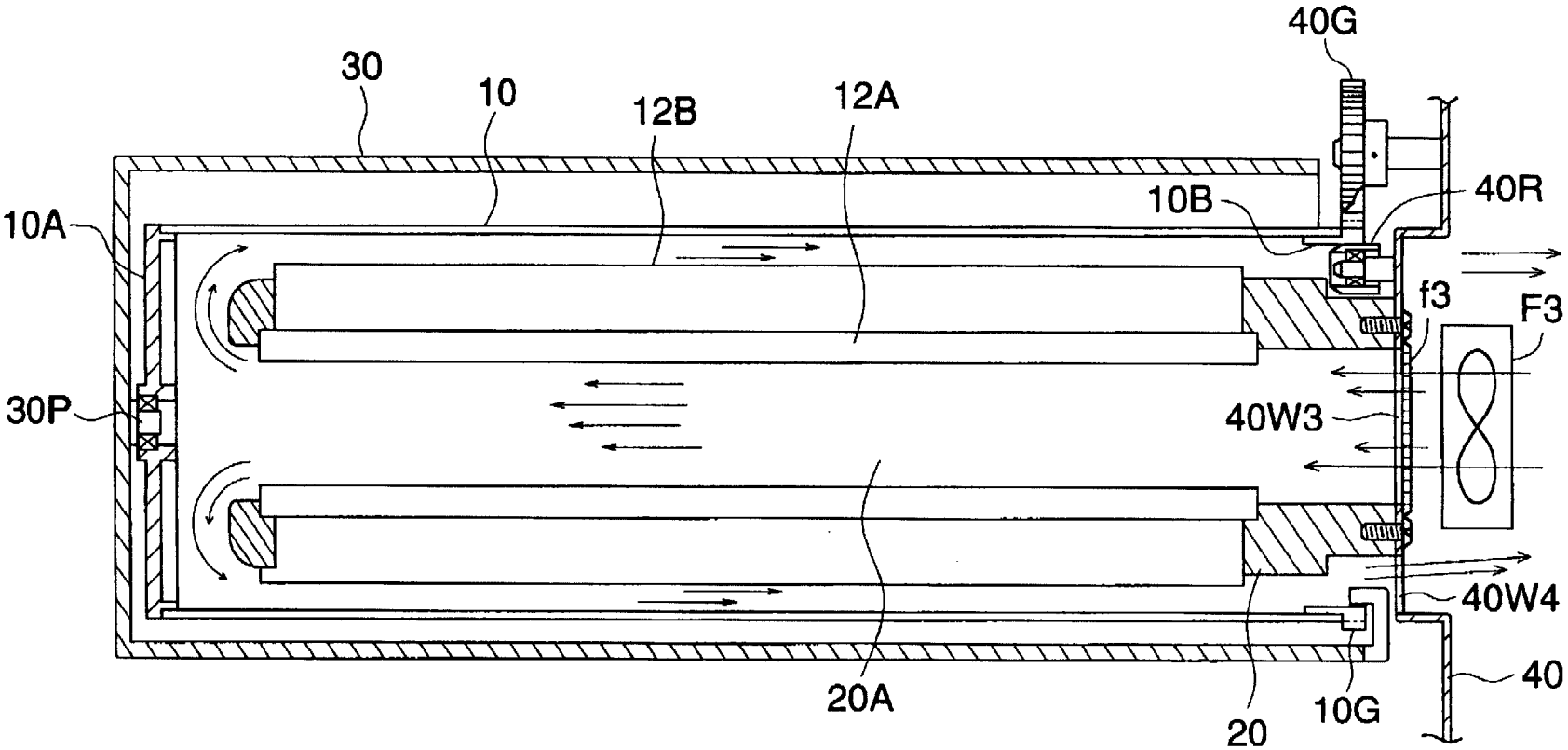
FIG. 31 is a sectional view showing the cooling means provided inside the photoreceptor of the first example of the second embodiment to accomplish the fourth object.

As shown in FIG. 31, in order to enhance the cooling and cleaning effects provided by each air current, each LED 12A is provided with radiating fins. Also, a filter f3 for filtering dust is attached to the suction hole 40W3.

Figure 32:
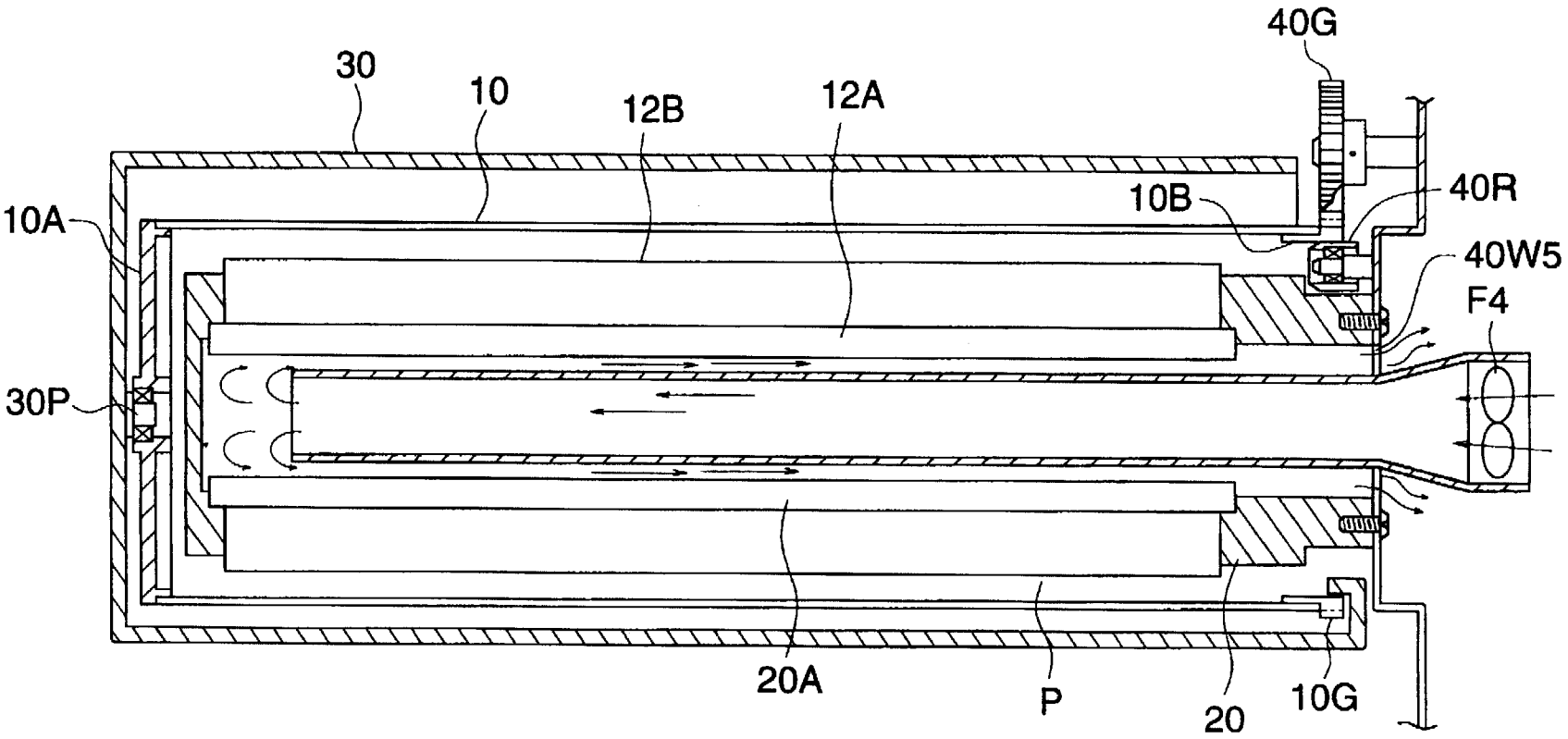
FIG. 32 is a sectional view showing the cooling means provided inside the photoreceptor of the second example of the second embodiment.

In the second example illustrated in FIG. 32, the hollow portion 20A is provided at the center of the support member 20, and one end of the hollow portion 20A is closed. LED 12A of each optical exposure system 12 protrudes from the peripheral surface of the hollow portion 20A. Ventilating tube P inserted into the exhaust hole 40W5 on the base plate 40 is accommodated in the hollow portion 20A.

Propeller fan F4 is provided at an end of the ventilating tube P on the base plate side 40. A predetermined clearance is provided between the outer periphery of the ventilating tube P and the inner surface of the support member 20. This clearance continues to the exhaust hole 40W5.

In accordance with a signal of the detection sensor for detecting the temperature inside the support member 20, propeller fan F4 is operated. By the sucking action of the propeller fan, air outside of the base plate 40 is sucked into the ventilating tube P. A current of the sucked air is reversed at the end of the support member 20 and sent into the clearance inside the support member 20. In this way, an air current is formed in the axial direction of the drum.

The air current formed inside of the support member 20 directly cools LED 12A of each optical exposure system 12 and absorbs the heat. By the action of propeller fan F4, the air current is discharged outside from the exhaust hole 40W5 provided on the base plate 40.

In order to enhance the cooling and cleaning effects provided by each air current, each LED 12A is provided with radiating fins.

In each of the above examples, the present invention is applied to an image forming apparatus having a drum-shaped image forming body. However, it should be understood that the present invention can be applied to an image forming apparatus having a belt-shaped image forming body inside which each optical exposure means is accommodated, and the same cooling effects can be provided.

According to the present invention, even when image formation is continued over a long period of time, the image exposure means is not overheated, so that the temperature inside the image forming body can be maintained in an appropriate range. As a result, the photoreceptor and toner are not deteriorated and further the registration is not changed. Accordingly, it is possible to provide a color image forming apparatus by which images of high quality can be continuously formed.

Figure 33:
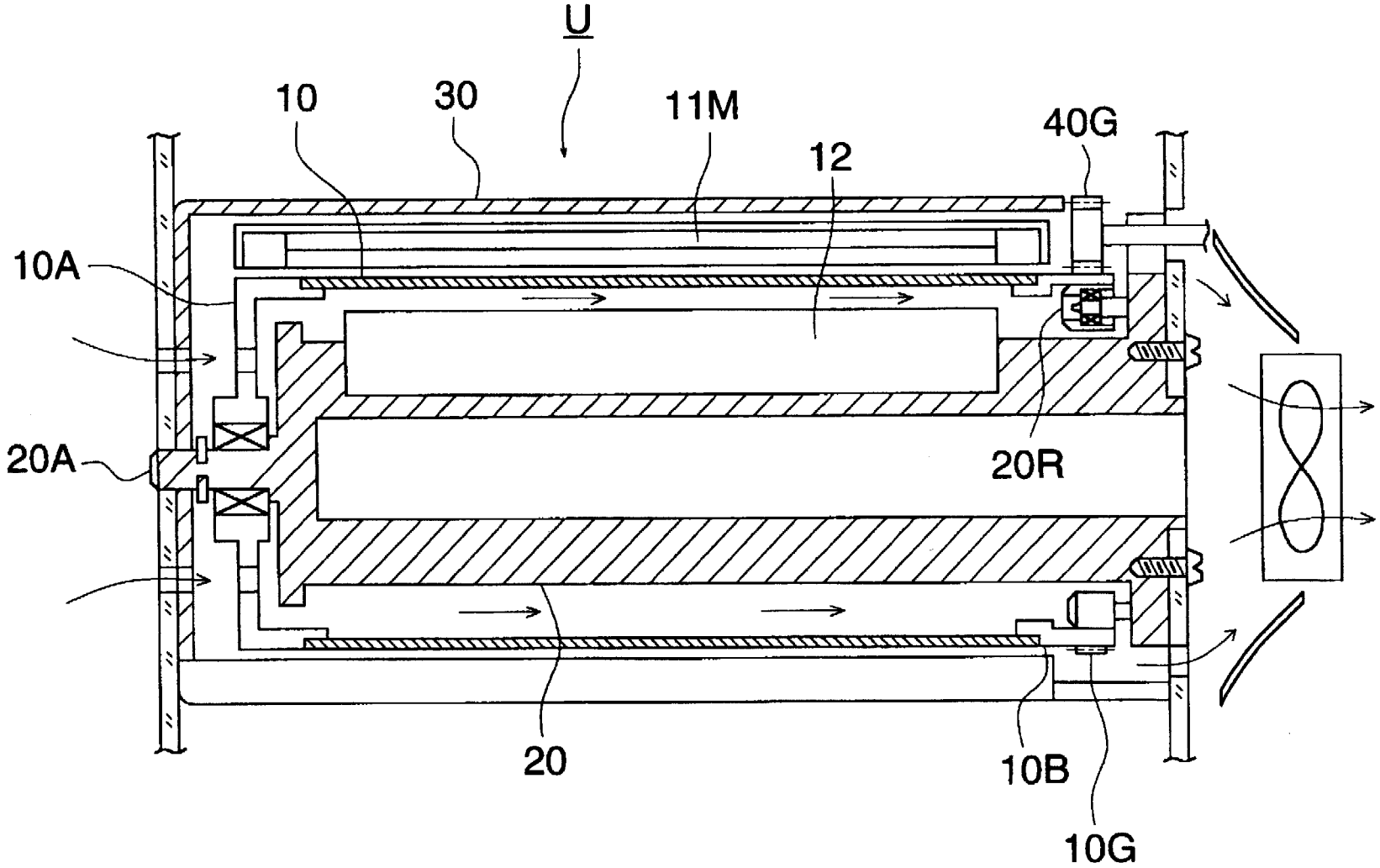
FIG. 33 is a sectional view showing the cooling means provided inside the photoreceptor of FIG. 4.
Figure 34:
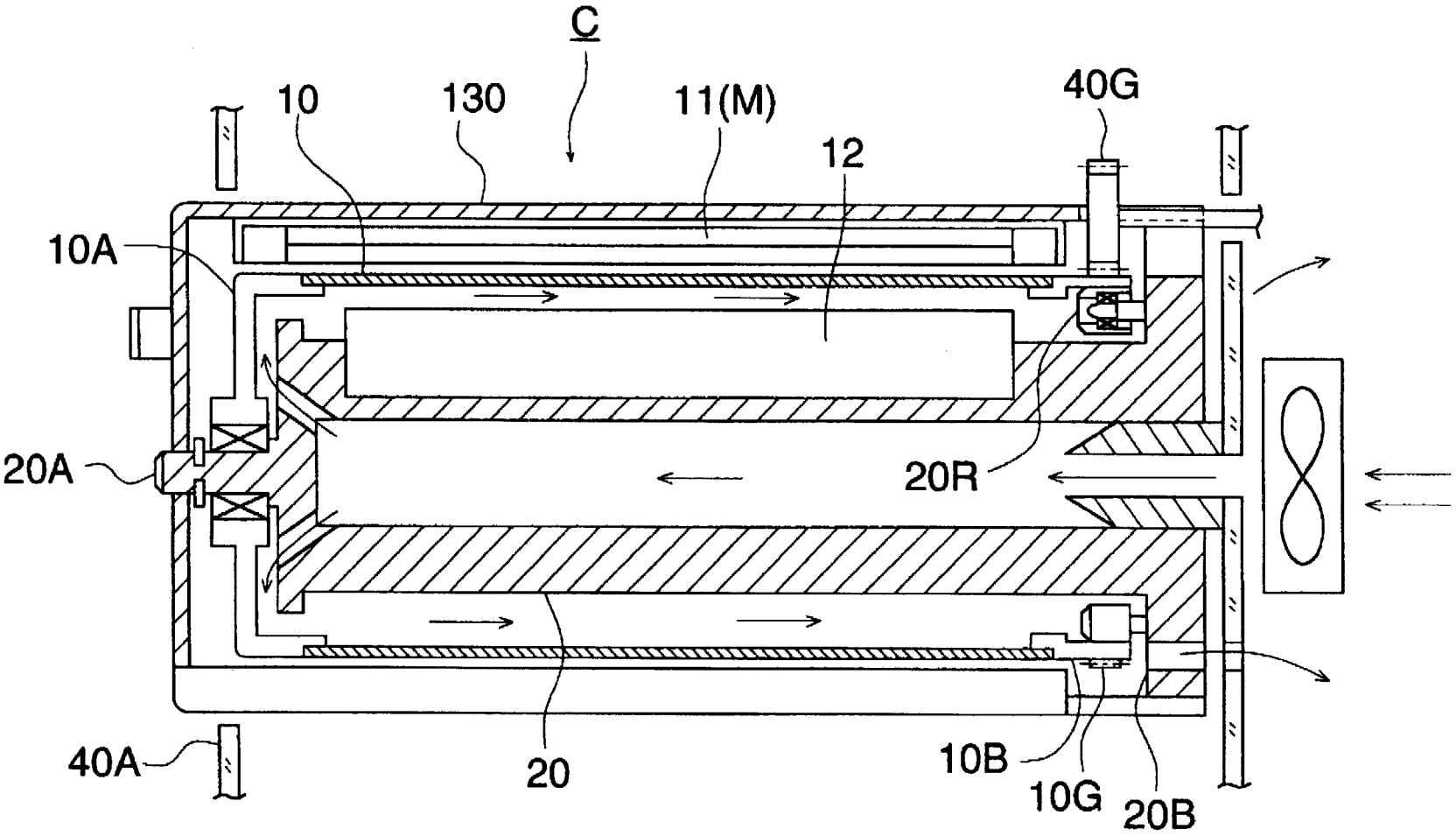
FIG. 34 is a sectional view showing the cooling means provided inside the photoreceptor of FIG. 6.

Incidentally, as one example to explain the invention, a constitution to attain the forth object is applied to the apparatus corresponding to the second embodiment to attain the first object in which the image exposure means is fixed in the housing (the apparatus body) and is not incorporated in the unit including the photoreceptor drum. However, as shown in FIGS. 33 and 34, a constitution to attain the forth object can be also applied to the apparatus corresponding to the first embodiment to attain the first object in which the image exposure means is incorporated in the unit including the photoreceptor drum.

What is claimed is:

1. An apparatus for forming a toner image, comprising:

a photoreceptor drum provided with a disk which closes one end thereof so that the photoreceptor drum has a closed drum end and an open drum end;

charger means for charging an outer surface of the photoreceptor drum;

image exposure means for exposing the photoreceptor drum from an inside of the photoreceptor drum so as to form a latent image thereon;

developing means for developing the latent image so as to form a toner image on an outer surface of the photoreceptor drum;

an image exposure means supporting member on which the image exposure means are mounted, the image exposure means supporting member being inserted together with the image exposure means through the open drum end into the inside of the photoreceptor drum, the image exposure means supporting member having a first end and a second end corresponding in position in an inserted condition to the closed end and the open end, respectively;

a shaft, one end of which is attached to the first end of the image exposure means supporting member and an opposite end of which is engageable with a center of the disk of the photoreceptor drum so that the closed drum end of the photoreceptor drum is rotatable around the shaft;

a photoreceptor drum supporting member engageable with the open drum end of the photoreceptor drum so that the open drum end of the photoreceptor drum is rotatable around the photoreceptor drum supporting member, the photoreceptor drum supporting member being provided in a vicinity of the second end of the image exposure means supporting member so that when the photoreceptor drum is shifted from the first end to the second end of the image exposure means supporting member, the image exposure means supporting means is inserted through the open drum end into the inside of the photoreceptor drum, the closed drum end of the photoreceptor drum is engaged with the opposite end of the shaft and the open drum end of the photoreceptor drum is engaged with the photoreceptor drum supporting member.

2. The apparatus of claim 1, further comprising an apparatus body and a unit holding at least one element of said apparatus and mounted in the apparatus body.

3. The apparatus of claim 2, further comprising a base plate on which the second end of the image exposure means supporting member and the photoreceptor drum supporting member are fixed.

4. The apparatus of claim 3, wherein the base plate is a second wall member of said unit so that the photoreceptor drum and the image exposure means are incorporated in the unit.

5. The apparatus of claim 4, wherein the shaft, the image exposure means supporting member, and the base plate are made as a single piece.

6. The apparatus of claim 5, wherein the unit comprises a first wall member opposite to the base plate and the opposite end of the shaft is supported by the first wall member.

7. The apparatus of claim 3, wherein the base plate is a wall member of the apparatus body so that the photoreceptor drum is incorporated in the unit and the image exposure means is fixed on the apparatus body.

8. The apparatus of claim 7, wherein the unit comprises a first wall member opposite to the base plate and the opposite end of the shaft is fixed to the first wall member so as to rotatably support the photoreceptor drum in the unit, and wherein when the unit is mounted in the apparatus body, the one end of the shaft is attached to the first end of the image exposure means supporting member.

9. The apparatus of claim 2, wherein the charging means and the photoreceptor drum are both provided in the unit.

10. The apparatus of claim 9, wherein the image exposure means, the image exposure means supporting means, and the photoreceptor drum supporting means are additionally provided in the unit.

11. The apparatus of claim 1, wherein the photoreceptor drum supporting member comprises a plurality of support rollers.

12. The apparatus of claim 11, wherein each of the plurality of support rollers is inscribed with an inner peripheral surface of the photoreceptor drum.

13. The apparatus of claim 1, further comprising means for generating an air current in the photoreceptor drum.

14. The apparatus of claim 1, wherein the image exposure means includes a fin to radiate heat.

15. The apparatus of claim 1, wherein each of the charging means, the developing means and the image exposure means is provided in plural sets corresponding in number to color components to form a full color, and wherein the plural charging means and the plural developing means are arranged around an outer periphery of the photoreceptor drum and the plural image exposure means are mounted on the image exposure means supporting member and inserted inside the photoreceptor drum.

16. The apparatus of claim 15, wherein each of the plural image exposure means is independently detachably mounted on the image exposure means supporting member.

17. The apparatus of claim 16, wherein a gap distance between each of the plural image exposure means and the photoreceptor drum is set by positioning each of the plural image exposure means on the image exposure means supporting member.

18. The apparatus of claim 15, further comprising a driving gear fixed in the apparatus body at a position corresponding to a rotation axis of the photoreceptor drum, and a driving force transmitting means for transmitting a driving force from the driving gear to the plural developing means.

19. The apparatus of claim 15, further comprising a driving gear fixed in the apparatus body and a driving force transmitting means for transmitting a driving force from the driving gear to the photoreceptor drum.

20. The apparatus of claim 19, wherein the photoreceptor drum comprises a gear formed integrally with the outer periphery of the photoreceptor drum.

21. The apparatus of claim 1, wherein the disk of the photoreceptor drum is provided with an opening.

22. The apparatus of claim 21, wherein the inside of the photoreceptor drum is cooled by air fed through the opening of the disk.

23. An apparatus for forming a toner image, comprising:

a photoreceptor drum having an open end;

charger means for charging an outer surface of the photoreceptor drum;

image exposure means for exposing the photoreceptor drum to form a latent image thereon;

developing means for developing the latent image so as to form a toner image on an outer surface of the photoreceptor drum;

an image exposure means supporting member on which the image exposure means are mounted, the image exposure means supporting member having a first end and a second end;

a first supporting member provided in a vicinity of the second end of the image exposure means supporting member so that when the image exposure means supporting member is inserted through the open drum end into the inside of the photoreceptor drum and assembled with the photoreceptor drum, the first supporting member supports the open drum end of the photoreceptor drum so as to allow the rotation of the photoreceptor drum around the image exposure means;

a second supporting member having a first portion and a second portion, wherein the first portion is attached to an end of the photoreceptor drum opposite to the open drum end, and when the image exposure means supporting member is inserted through the open drum end into the inside of the photoreceptor drum and assembled with the photoreceptor drum, the second portion is engaged with the first end of the image exposure means supporting member so as to allow the rotation of the photoreceptor drum around the image exposure means.

24. The apparatus of claim 23, wherein the second supporting member comprises a disk which closes the end of the photoreceptor drum opposite to the open end of the photoreceptor drum.

25. The apparatus of claim 24, wherein the first portion of the second supporting member is formed by a periphery of the disk.

26. The apparatus of claim 24, wherein the second supporting member comprises a shaft around which the disk is rotatable, and wherein the second portion comprises the shaft.

27. The apparatus of claim 26, wherein the shaft has one end which is engageable with the first end of the image exposing means supporting member.

28. The apparatus of claim 26, wherein the shaft is fixed to the first end of the image exposing means supporting member and is engageable with the disk.

29. The apparatus of claim 24, wherein the disk is provided with an opening.

30. The apparatus of claim 29, wherein the inside of the photoreceptor drum is cooled by air fed through the opening of the disk.

31. The apparatus of claim 23, further comprising a base plate on which the second end of the image exposure means supporting member and the first supporting member are fixed.

* * * * *